US006419347B2

(12) United States Patent
Ono et al.

(10) Patent No.: US 6,419,347 B2
(45) Date of Patent: Jul. 16, 2002

(54) LIQUID EJECT HEAD, CARTRIDGE AND IMAGE FORMING APPARATUS, AND MANUFACTURING METHOD OF LIQUID EJECT HEAD

(75) Inventors: Takayuki Ono; Tomoyuki Hiroki; Masaru Iketani, all of Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/835,330

(22) Filed: Apr. 17, 2001

(30) Foreign Application Priority Data

Apr. 17, 2000 (JP) ..... 2000-115696
Apr. 6, 2001 (JP) ..... 2001-108556

(51) Int. Cl.[7] ..... B41J 2/05
(52) U.S. Cl. ..... 347/63; 347/65
(58) Field of Search ..... 347/20, 56, 40, 347/65, 54, 94, 63, 93

(56) References Cited

U.S. PATENT DOCUMENTS 4,698,645 A * 10/1987 Inamoto ..... 347/65
4,897,674 A * 1/1990 Hirasawa ..... 347/65
5,992,981 A * 11/1999 Sugitani et al. ..... 347/63

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

In order to avoid damages or deformations to ejection energy generating elements formed on a substrate or grooved plate, when the substrate and the grooved plate are joined, a liquid ejection head for an image forming apparatus includes a substrate having electro-thermal energy conversion elements thereon, a grooved plate having grooves formed at positions corresponding to the electro-thermal energy conversion elements, ejection ports communicating with the respective grooves, and liquid paths communicating with the ejection ports. At least two protrusions are formed on the substrate apart from each other and corresponding engaging recessed portions are formed on the grooved plate for engaging the protrusions. A height from the surface of the substrate to upper ends of the protrusions is set higher than a height from the surface of the substrate to upper ends of the electro-thermal energy conversion elements or other micro processed portions.

11 Claims, 18 Drawing Sheets

LIQUID EJECT HEAD, CARTRIDGE AND IMAGE FORMING APPARATUS, AND MANUFACTURING METHOD OF LIQUID EJECT HEAD

BACKGROUND OF THE INVENTION

1. Field of the Invention

The present invention relates to a liquid eject head to eject liquid droplets from eject ports, to a cartridge as a unit comprising the liquid eject head and a liquid tank for reserving the liquid to be supplied to the liquid eject head and to an image forming apparatus, and also relates to a manufacturing method of the liquid eject head.

2. Brief Description of the Related Art

Liquid paths communicated to eject ports are formed by joining together a substrate where micro processed portions including eject energy generating elements for ejecting liquid droplets are formed with a grooved plate where grooves at corresponding positions to the eject energy generating elements and eject ports communicated to one ends of the grooves are formed. In liquid eject heads where liquid droplets are ejected from the liquid paths via eject ports, the substrate and the grooved plate have to be joined together by keeping an accurate positioning between them.

Up to now the substrate and the grooved plate for the liquid eject head are joined according to the following positioning method.

After recognizing one eject energy generating element marked beforehand among eject energy generating elements formed on the substrate, the grooved plate is placed and moved without touching it on the substrate until the marked eject energy generating element reaches a position where a marked groove or marked eject port is formed. Or a positioning stopper to which the side end of the substrate is attached, is formed at end portion of the grooved plate so that the grooved plate is placed on the substrate and moved to a position where it is pressed against the positioning stopper.

Recently in order to meet requirements for finer image forming, eject ports more densely arranged on the liquid head have been realized. For that purpose, spacing between two neighboring liquid paths and a thickness of a partition wall to divide liquid paths should be formed thinner and thinner. When the grooved plate contacting with the substrate is moved on the substrate with keeping its contacting state, there are possibilities to deform or damage the grooved plate, or to damage eject energy generating elements formed on the substrate since the substrate is not perfectly flat. Consequently, lower ends of partition walls formed on the grooved plate scratch the substrate.

Such damages or deformations may cause cross talk between two neighboring liquid paths and make predetermined accurate ejection of liquid difficult, consequently printing quality is deteriorated. When eject energy generating elements are damaged, the printing quality is also deteriorated owing to deteriorated durability of eject heads and difficulties to keep normal ejecting performance.

When micro processed portions except the eject energy generating elements arranged on the substrate are damaged or deformed, durability of the eject heads is deteriorated and it becomes difficult to keep normal ejecting operations, which leads to deteriorated printing quality.

Since the above-mentioned problems increase along with demands for eject ports with higher density, an easy and fast positioning method is required without contacting the grooved plate to the substrate which is not formed perfectly flat.

In the method disclosed in the U.S. Pat. No. 5,992,981 where a positioning method between each eject energy generating element arranged on the substrate and each corresponding nozzle formed on the grooved plate is proposed, there is also a possibility to cause damages on micro processed portion. In other words in order to avoid such possibility to cause such damages on the micro processed portions, the height of walls forming liquid paths should be set larger than a sum of a height of protrusions formed outside the aligned row of eject energy generating element on the substrate and a height of walls arranged outside the aligned row liquid paths on the grooved plate for forming engaging recessed portions to engage the above-mentioned protrusions.

In some case, an external force is required in order to keep the substrate having the above-mentioned energy generating elements and the grooved plate having liquid paths at the positioning state in accordance with a geometry of the above-mentioned substrate. However, portions of the grooved plate accepting protrusions are deformed by the above-mentioned applied force, which causes friction when the grooved plate is moved on the substrate for the positioning. Consequently, requirements for enhancing strength around the protrusion and for excessive higher force to move the grooved plate, may result in deteriorated positioning accuracy.

SUMMARY OF THE INVENTION

A first objective of the present invention is to provide the liquid eject head manufactured by precise positioning and joining the substrate against the grooved plate without causing any damage or deformation on the eject energy generating elements on the substrate and partition walls on the grooved plate.

A second objective of the present invention is to provide a cartridge where the above-mentioned liquid eject head and a liquid tank to reserve ink for supplying to the liquid head are combined as a unit.

A third objective of the present invention is to provide an image forming apparatus where a device for attaching the above-mentioned cartridge is arranged for forming image on a printing medium.

A fourth objective of the present invention is to provide a manufacturing method of the above-mentioned liquid eject head.

A first embodiment of the liquid eject head to attain the first objective of the present invention comprises: the substrate having a plurality of eject energy generating elements for ejecting liquid droplets, a plurality of micro processed portions including eject energy generating elements and a first surface arranged the plurality of micro processed portions thereon, and the grooved plate having a plurality of eject ports for ejecting liquid droplets, a plurality of grooves communicating to a plurality of respective eject ports for forming liquid paths and a second surface arranged the plurality of grooves thereon, wherein; the first surface and second surface are fitted together so as to keep a state where respective eject energy generating elements face against corresponding grooves, the substrate has at least two protrusions, a width of the protrusion in an arranged direction of liquid paths being set larger than the width of the liquid path and a height of the protrusion from the first surface being set higher than a height of micro processed portion, and the grooved plate has engaging recessed portions for positioning the grooved plate against the substrate by engaging protrusions with engaging recessed portions, and; a summed up height comprising; a height of the wall of the engaging recessed portion from a ceiling of the liquid path and a height of the protrusion is set larger than a height of partition walls parting liquid paths from the ceiling of the liquid path.

In this embodiment protrusions may formed outside of the arranged row of eject energy generating elements. Or an engaging recessed portion is formed on opposite side against grooves so as to communicate to a common liquid chamber and so as to function partly as the engaging recessed portion to the protrusion.

Upper ends of the protrusions may be formed as flat plane parallel to the surface of the substrate.

The eject energy generating element may an electro-thermal energy conversion element for generating thermal energy to cause a film boiling in the liquid for ejecting liquid from the eject port.

A second embodiment of the cartridge to attain the second objective of the present invention equipped with a liquid eject head which comprises: the substrate having a plurality of eject energy generating elements for ejecting liquid droplets, a plurality of micro processed portions including eject energy generating elements and a first surface arranged the plurality of micro processed portions thereon, and the grooved plate having a plurality of eject ports for ejecting liquid droplets, a plurality of grooves communicating to a plurality of respective eject ports for forming liquid paths and a second surface arranged the plurality of grooves thereon, wherein; the first surface and second surface are fitted together so as to keep a state where respective eject energy generating elements face against corresponding grooves, the substrate has at least two protrusions, a width the protrusion in an arranged direction of liquid paths being set larger than the width of the liquid path and a height of the protrusion from the first surface being set higher than a height of micro processed portions, and the grooved plate has engaging recessed portions for positioning the grooved plate against said substrate by engaging protrusions with engaging recessed portions, and; a summed up height comprising; a height of the wall of the engaging recessed portion from a ceiling of the liquid path and the height of the protrusion is set larger than a height of partition walls parting liquid paths from the ceiling of the liquid path.

In the cartridge according to this embodiment, the liquid tank may be demountably mounted to the cartridge.

The liquid may be a treatment liquid to adjust printing quality of the ink and/or ejected ink on the printing medium.

A third embodiment of the image forming apparatus to attain the first objective of the present invention having the device for attaching the liquid eject head which comprises: the substrate having a plurality of eject energy generating elements for ejecting liquid droplets, a plurality of micro processed portions including eject energy generating elements and a first surface arranged the plurality of micro processed portions thereon, and the grooved plate having a plurality of eject ports for ejecting liquid droplets, a plurality of grooves communicating to a plurality of respective eject ports for forming liquid paths and a second surface arranged the plurality of grooves thereon, wherein; the first surface and second surface are fitted together so as to keep a state where respective eject energy generating elements face against corresponding grooves, the substrate has at least two protrusions, a width of the protrusion in an arranged direction of liquid paths being set larger than the width of the liquid path and a height of the protrusion from the first surface being set higher than a height of micro processed portions, and the grooved plate has engaging recessed portions for positioning the grooved plate against the substrate by engaging protrusions with engaging recessed portions, and; a summed up height comprising; a height of the wall of the engaging recessed portion from the ceiling of the liquid path and a height of the protrusion is set larger than a height of partition walls parting liquid paths from the ceiling of the liquid path.

In the image forming apparatus according to the third embodiment the device for attaching the liquid eject head may be a carriage which is capable of scanning and moving across a feeding direction of the printing medium onto which the liquid is ejected from the liquid eject head. In this case the liquid eject head may be demounted to the carriage by a demounting means.

A fourth embodiment of the manufacturing method of the liquid head to attain the fourth objective of the present invention wherein: the substrate having a plurality of eject energy generating elements for ejecting liquid droplets, a plurality of micro processed portions including eject energy generating elements and a first surface arranged the plurality of micro processed portions thereon and the grooved plate having a plurality of eject ports for ejecting liquid droplets, a plurality of grooves communicating to a plurality of respective eject ports for forming liquid paths and a second surface arranged the plurality of grooves are formed are arranged, wherein; the first surface and second surface are fitted together so as to keep a state where respective eject energy generating elements face against corresponding grooves, wherein the manufacturing method of the liquid eject head comprises steps of: forming at least two protrusions having a width of the protrusion in an arranged direction of the liquid paths being set larger than the width of the liquid path and a height of the protrusion from the first surface being set higher than a height of the micro processed portions, apart from each other on the substrate, forming corresponding engaging recessed portions having a height of the wall of the engaging recessed portion from the ceiling of the liquid path, wherein; a summed up height comprising; a height of the wall of the engaging recessed portion from the ceiling of the liquid path and a height of the protrusion is set larger than a height of partition walls parting liquid paths from the ceiling of the liquid path, mounting the grooved plate on upper ends of protrusions, moving the grooved plate along upper ends of protrusions and engaging protrusions with engaging recessed portions.

In the manufacturing method of the liquid eject head according to the fourth embodiment, force to move the grooved plate is applied preferably parallel to the surface of the substrate.

Engaging protrusions to engaging recessed portions is preferably executed by gravity force caused by own weight of the grooved plate.

Other embodiment of manufacturing method of the liquid eject head to attain the fourth objective of the present invention is carried out as follows. A liquid head comprising a substrate having a plurality of eject energy generating elements for ejecting liquid droplets, a plurality of micro processed portions including eject energy generating elements and a first surface arranged the plurality of micro processed portions thereon, and a grooved plate having a plurality of eject ports for ejecting liquid droplets, a plurality of grooves communicating to a plurality of respective eject ports for forming liquid paths and a second surface arranged the plurality of grooves thereon, wherein; the first surface and second surface are fitted together so as to keep a state where respective eject energy generating elements face against corresponding grooves, wherein the manufacturing method of said liquid eject head comprises steps of; forming at least two protrusions on the substrate having a width of the protrusion in an arranged direction of eject energy generating elements is set more than a maximum offset value including its accuracy value, further forming corresponding engaging recessed portions on the grooved plate having a length larger than the width of the upper end of the protrusion and also larger than the maximum offset value including its accuracy value, mounting the grooved plate against the substrate, moving the grooved plate along upper ends of protrusions, and engaging the protrusions with the engaging recessed portions.

BRIEF DESCRIPTION OF DRAWINGS

FIG. 16A is a plan view and FIG. 16B is a perspective view of FIG. 16A.

DETAILED DESCRIPTION OF THE PREFERRED EMBODIMENTS

Though embodiments where the present invention is applied to ink-jet methods are explained in detail by referring FIG. 1 to FIG. 20, present invention is not limited to the explained embodiments, but is applicable to any combinations of the embodiments and other technologies which include claims described in the present invention.

Embodiment 1

Figure 1:
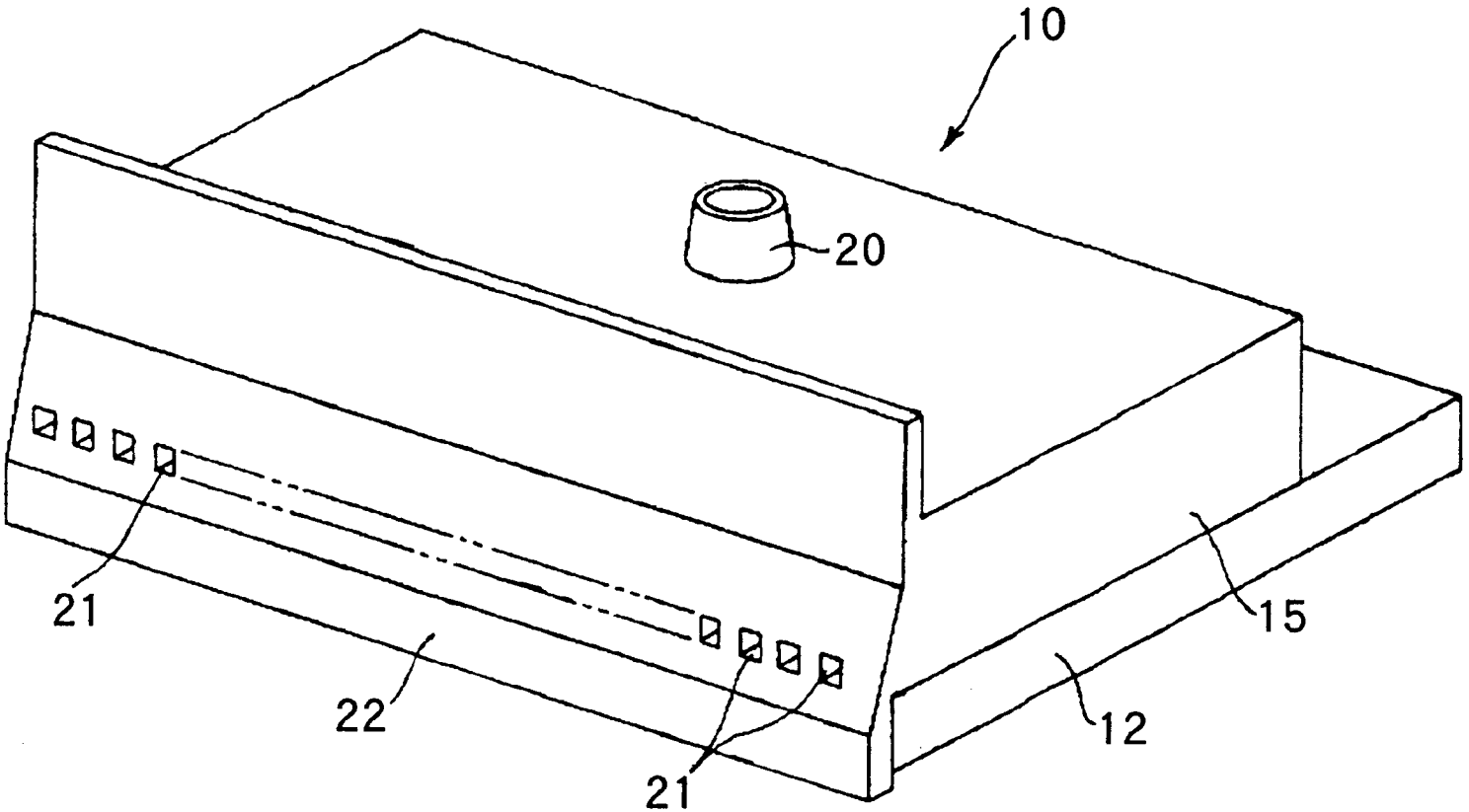
FIG. 1 is a perspective view showing an appearance of a first embodiment where the liquid eject head is applied to ink-jet head according to the present invention.
Figure 2:
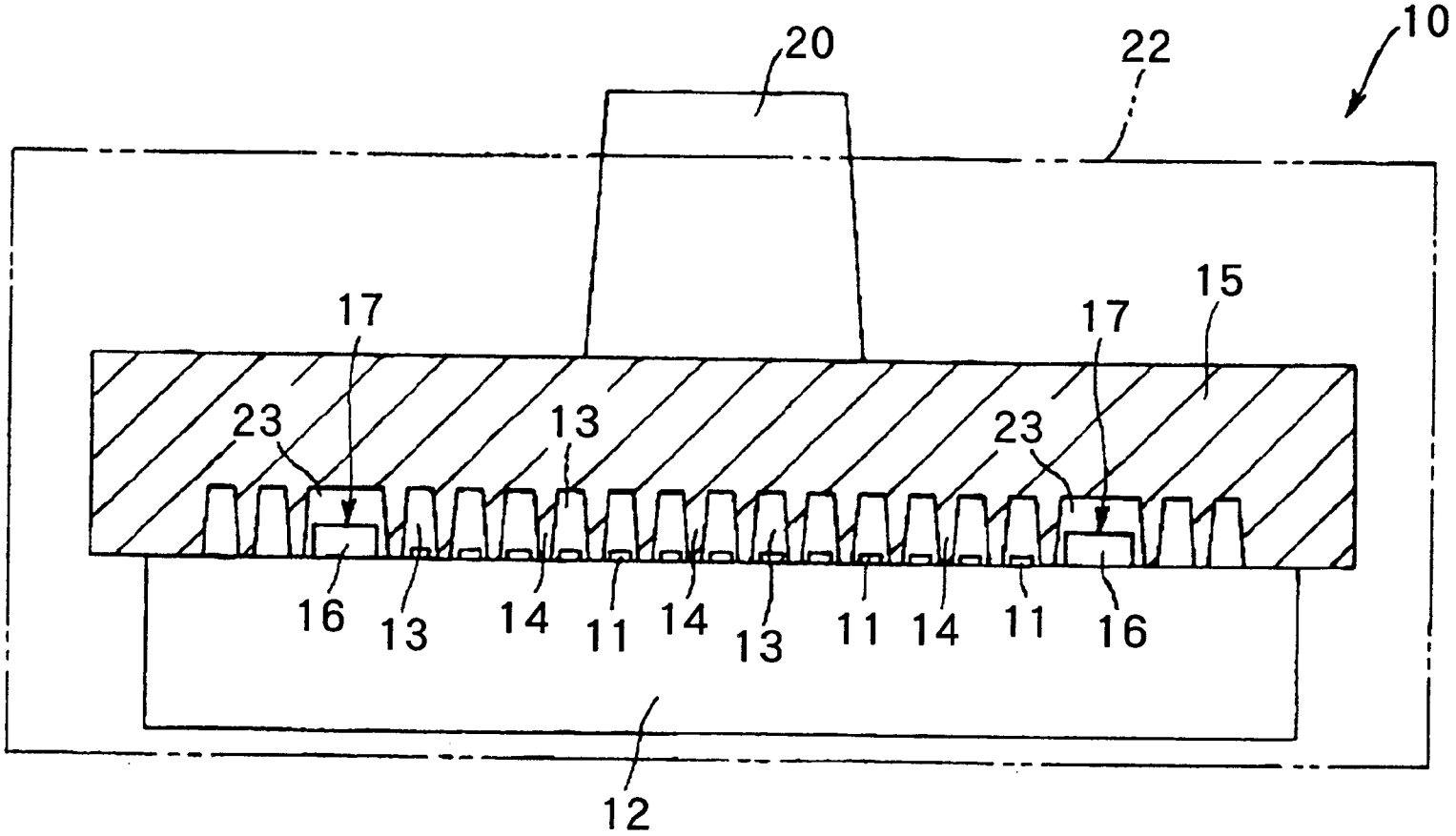
FIG. 2 is a front view of the ink-jet head in FIG. 1 with a state where an eject port plate is removed.
Figure 3:
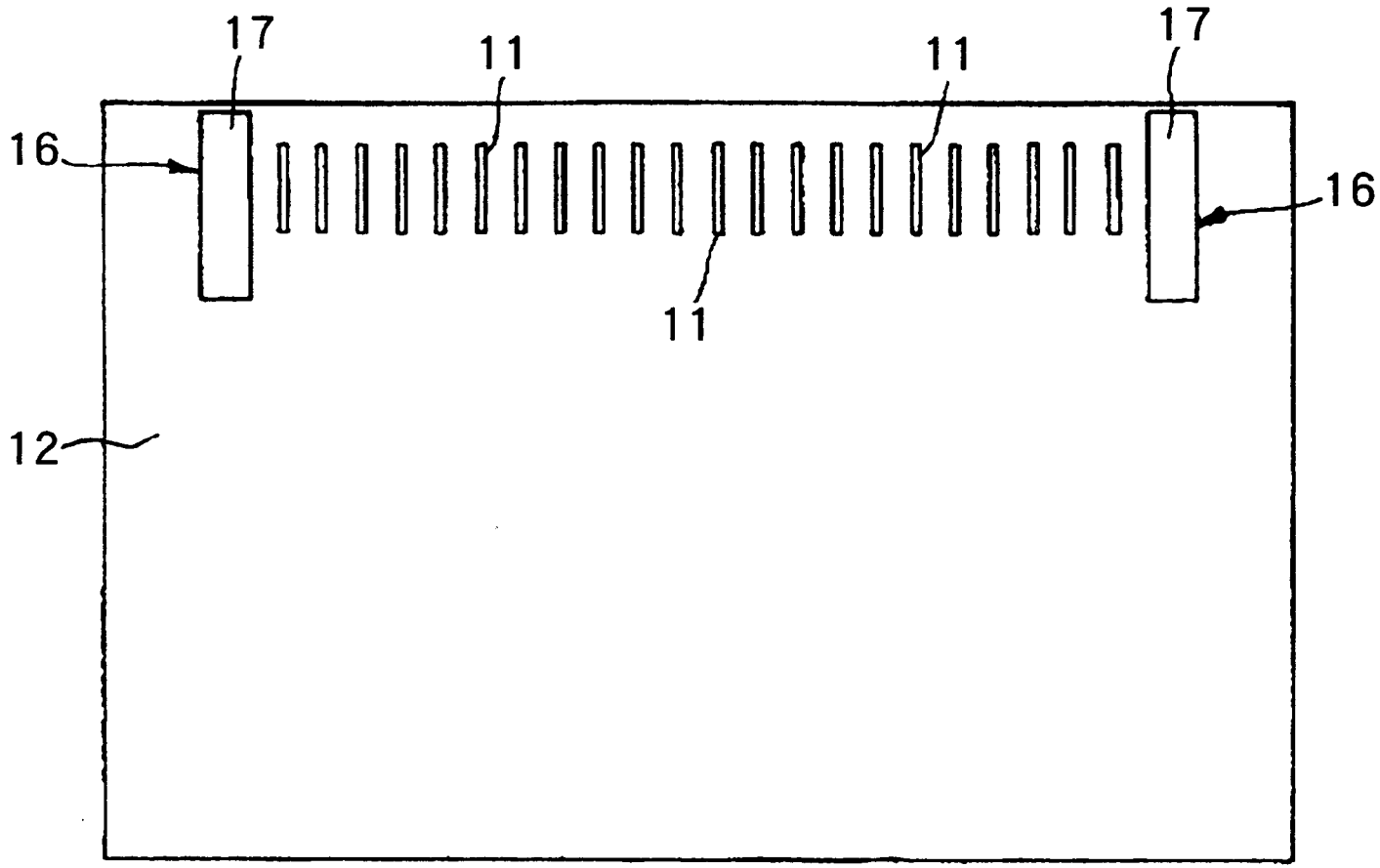
FIG. 3 is a plan view of a substrate of the ink-jet head in FIG. 1.
Figure 4:
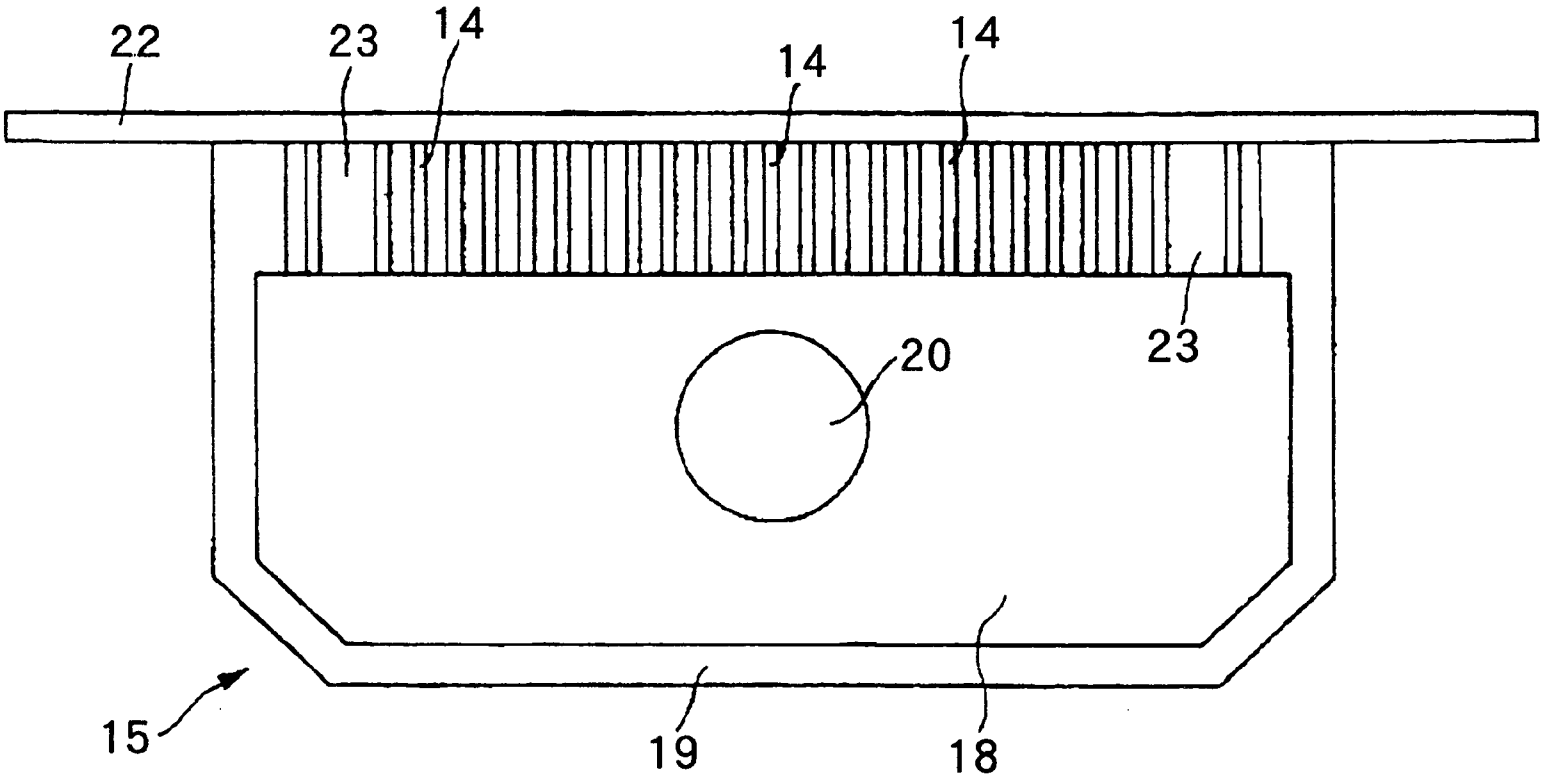
FIG. 4 is a rear view of a grooved plate of the ink-jet head in FIG. 1.

FIG. 1 is the perspective view of the ink-jet head according to the present invention. FIG. 2 is the plan view of the ink-jet head shown in FIG. 1 in a state where an eject port plate is omitted. A plan view of the substrate is shown in FIG. 3. A rear side view of the grooved plate is shown in FIG. 4. The ink-jet head 10 in this embodiment manufactured by a semi-conductor manufacturing method such as an etching method, a vapor deposition method or a sputtering method etc., comprises a substrate 12 on which electro-thermal energy conversion elements 11 as eject energy generating elements are arranged on a straight line with the same pre-determined spacing and a grooved plate 15 on which groove partition walls 14 for forming liquid paths 13 by connecting the grooved plate 15 to the substrate 12.

A pair of protrusions 16 protruding above electro-thermal energy conversion elements 11 are formed at both sides of aligned row of electro-thermal energy conversion elements 11 on the surface of the substrate 12. Upper ends of protrusions 16 are formed flat parallel to the surface of the substrate 12. The height from the surface of the substrate 12 to the upper end of protrusions 16 is set higher than the height from the surface of the substrate 12 to the upper end of electro-thermal energy conversion elements 11. A width of protrusions 16 along the aligned direction of electro-thermal energy conversion elements 11 is set larger than the predetermined spacing of groove partition walls 14 for forming liquid paths 13, which enables the protrusions 16 to prevent from being inserted into the liquid paths 13.

On the above-mentioned grooved plate 15 the following members except the above-mentioned groove partition walls 14 are arranged; a liquid chamber frame 19 which forms a common liquid chamber 18 communicated to each liquid path 13 parted by groove partition walls 14, a liquid supplying port 20 for leading the liquid from a liquid tank (not shown in figures) to the common liquid chamber 18 via a liquid supplying pipe (not shown in figures), an eject port plate 22 where eject ports 21 communicating to liquid paths 13 formed on the grooved plate 15 are formed on a straight line with the same predetermined spacing and a pair of engaging recessed portions 23 for engaging formed outside both ends of groove partition walls 14 so as to face against protrusions 16 on the substrate 12. A pair of engaging recessed portions 23 have enough spaces for accommodating protrusions 16. When the positioning of the grooved plate 15 against the substrate 12 is completed, protrusions 16 are accommodated in engaging recessed portions 23.

It is possible to form engaging recessed portions 23 by removing several groove partition walls 14. In this embodiment dummy liquid paths where no electro-thermal energy conversion elements 11 are arranged, are formed outside of engaging recessed portions 23.

The liquid is supplied into the common liquid chamber 18 from the liquid supplying port 20 via the unshown liquid tank through liquid supply pipe, and then is led into liquid paths 13 by the capillary effect and finally is stably kept in each liquid path 13 due to a formed meniscus by the surface tension of the liquid at an eject port 21 arranged at the end of the liquid path 13. When electric power is applied to electro-thermal energy conversion elements 11 arranged in each liquid path 13, liquid immediately above the electro-thermal energy conversion element 11 is heated and is ejected from eject ports 21 in the form of droplets with predetermined volume due to bubbles grew from instantly boiled liquid.

When the groove plate 15 is formed by an injection molding, sometimes it is warped by residing thermal stress owing to its geometry. When the warped grooved plate 15 is placed on the protrusions 16 formed on the substrate 12, there are possibilities that the groove partition walls 14 formed around the center portion of the grooved plate 15 strike against electro-thermal energy conversion elements 11.

Figure 5:
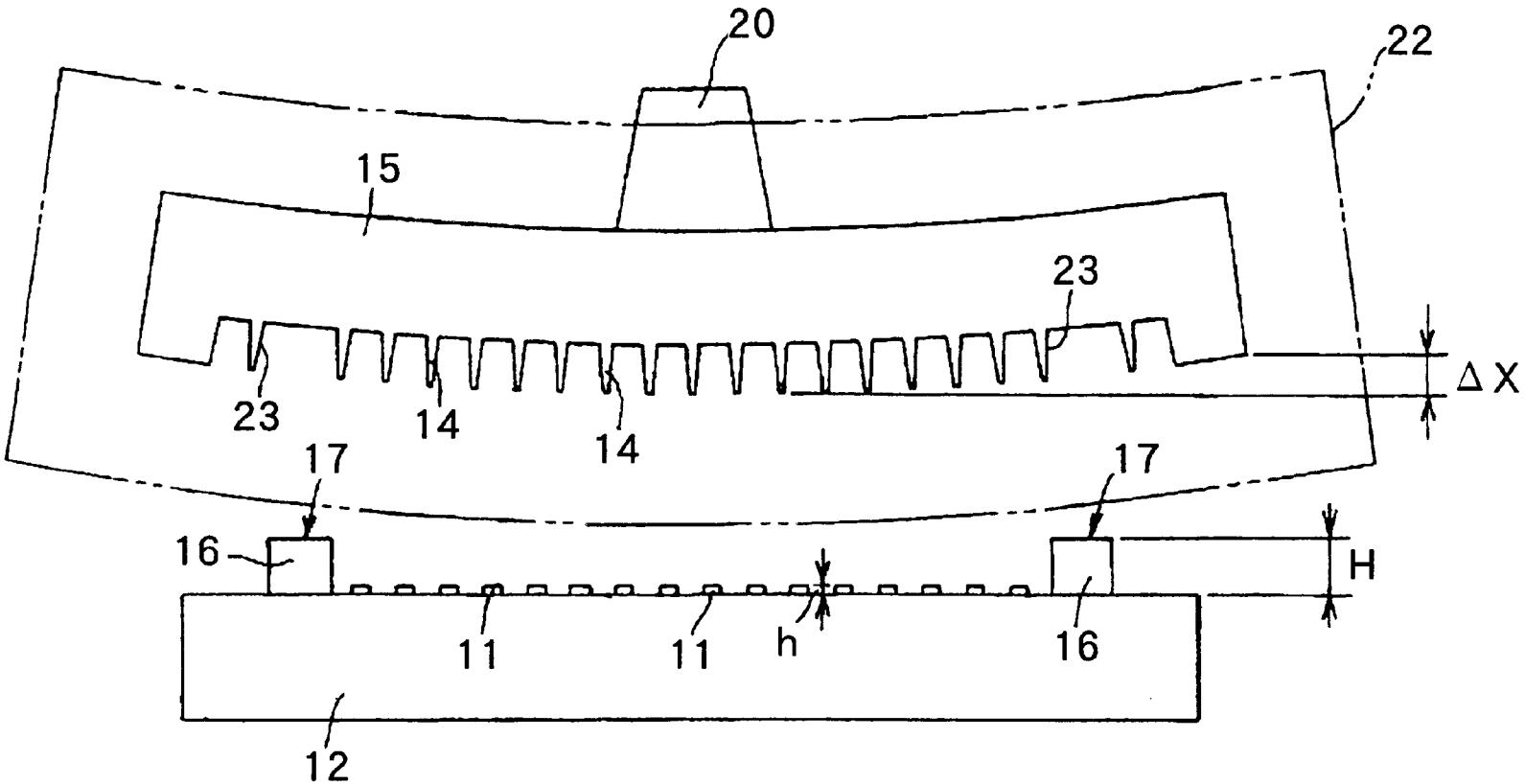
FIG. 5 is a schematic view illustrating a relation between protrusions and engaging recessed portions when the grooved plate is in a warped state.

In order to solve the above-mentioned problem, it is necessary to set the height from the surface of the substrate 12 to the upper end of the protrusion 16 larger than the height from the surface of the substrate 12 to the upper end of the electro-thermal energy conversion element 11. More specifically, when the center portion of the grooved plate 15 is protruded toward the substrate 12 as shown in FIG. 5, where a deformed extent of the grooved plate 15, namely, a warped extent and a height from the surface of the substrate to the upper end of the electro-thermal energy conversion element 11 are defined Δ X and h respectively, a height H for the protrusion 16 has to fulfill the following equation;

$$H \geqq \Delta X + h.$$

However, when the left side is equal to the right side in the above equation, there are probabilities that some of the lower ends of groove partition walls 14 may contact to electro-thermal energy conversion elements 11 even if lower ends of groove partition walls 14 are mounted on protrusions 16. In order to avoid such possibilities, a clearance C for example ca. 0.0005 mm should be added namely the height H of protrusions 16 should be set according to the following equation;

$$H \geqq \Delta X + h + C.$$

In this embodiment it is assumed that only electro-thermal energy conversion elements 11 are protruding from the substrate 12, but when other micro processed portion having protruded portions higher than the upper surface of electro-thermal energy conversion elements 11, h in above equations should be re-defined as a distance between the upper end of the micro processed portion to the surface of the substrate 12.

Figure 7:
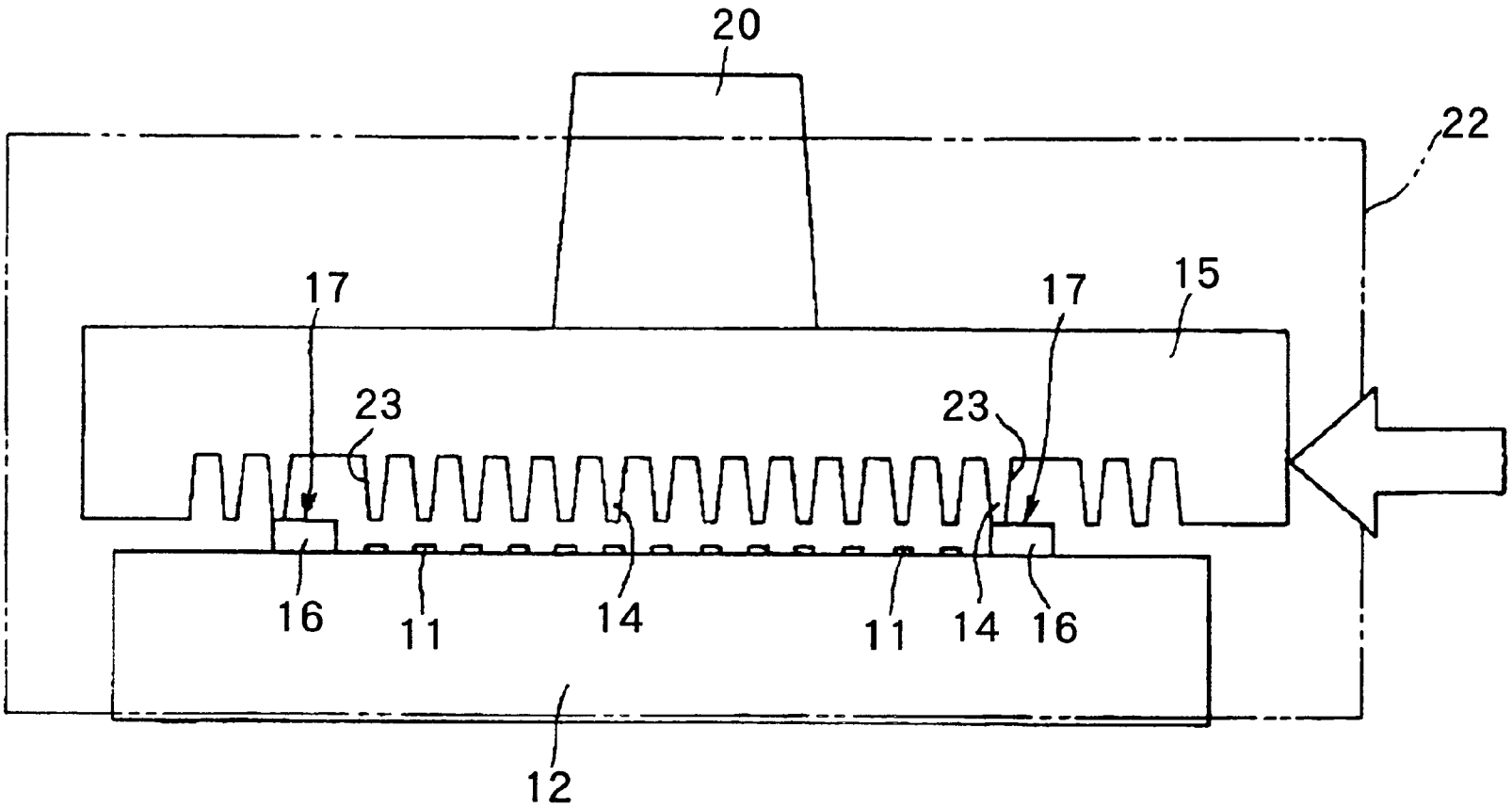
Figure 8:
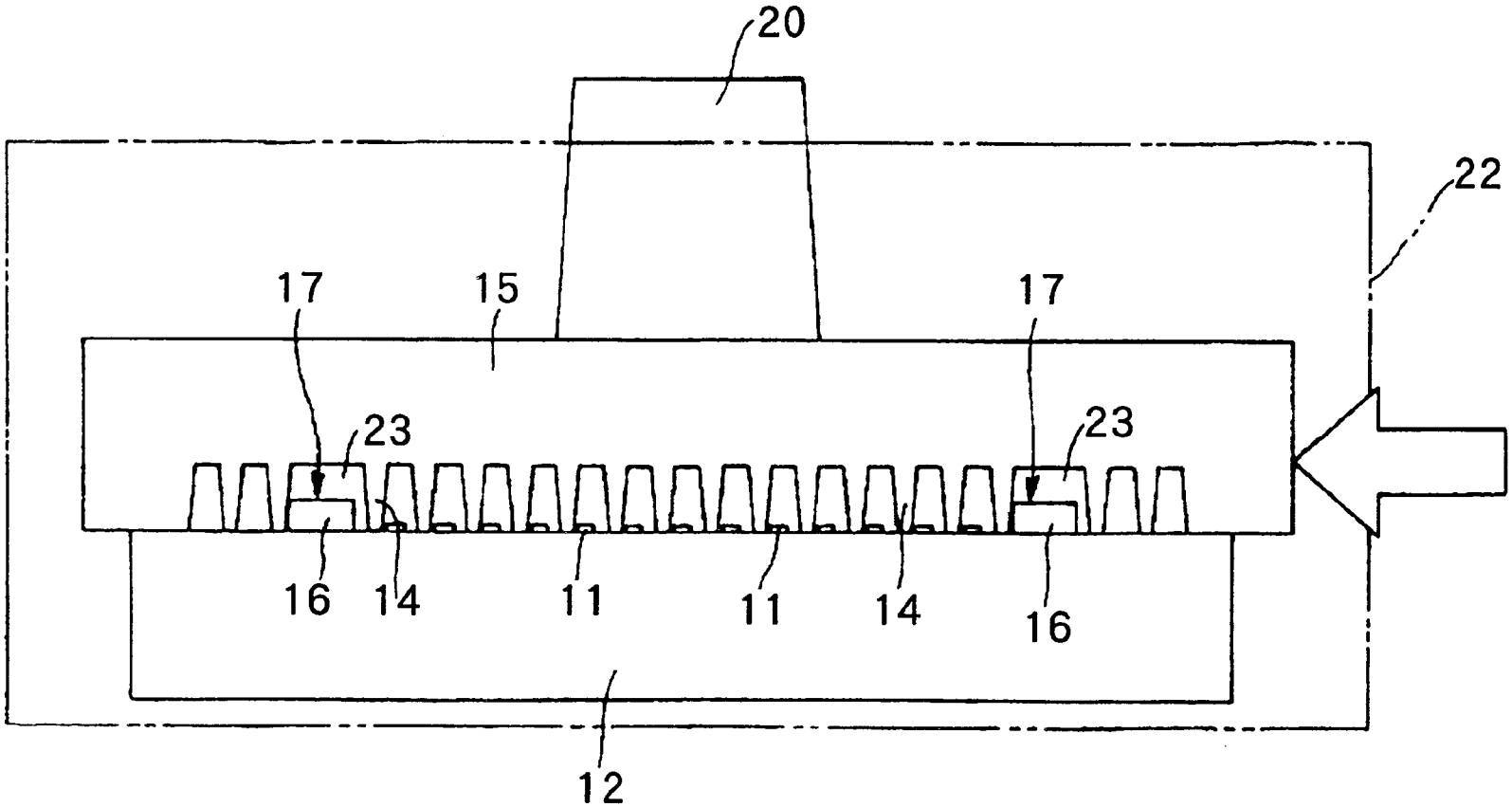
Figure 9:
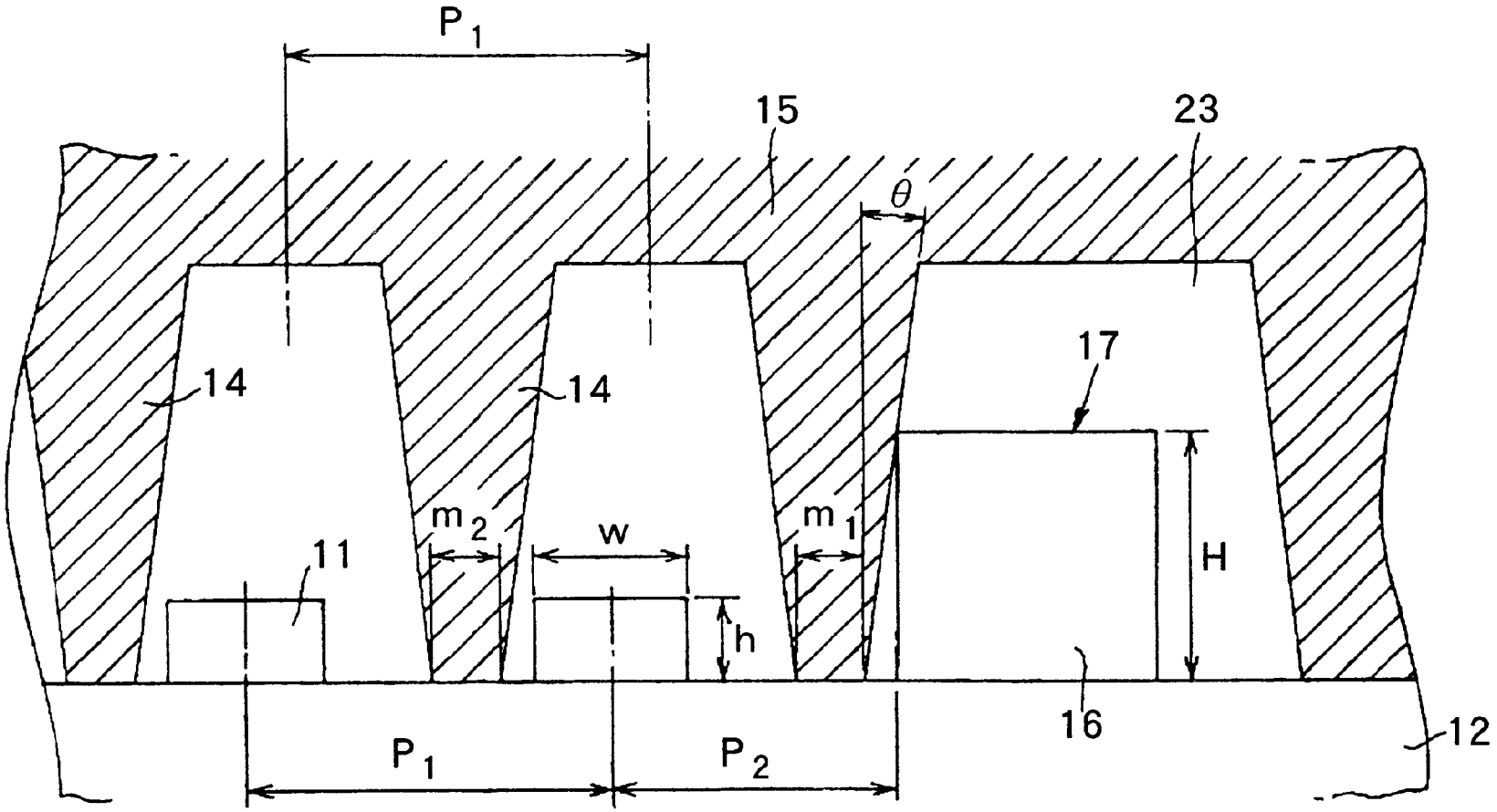
FIG. 9 is an enlarged front view illustrating a engaging status between the protrusion and the engaging recessed portion for engaging.

Hereinafter an assembling procedure of the ink-jet head 10 is described by referring FIG. 6 to FIG. 8. With the aid of an indirect contact image processing method or a direct contact method a pre-marked electro-thermal energy conversion element 11 formed on the substrate 12, is recognized as a reference. The grooved plate 15 is placed on the substrate 12 by referring the pre-marked electro-thermal energy conversion element as shown FIG. 6. At this stage, the lower ends of the groove partition walls 14 are mounted on upper surfaces 17 of protrusions 16 so that a gap is formed between lower ends of groove partition walls 14 and electro-thermal energy conversion elements 11. From the status shown in FIG. 6, the grooved plate 15 is moved leftward so that lower ends of groove partition walls 14 on the grooved plate 15 slide along upper surfaces 17 of protrusions 16 as shown FIG. 7. When the grooved plate 15 is slidingly moved by a predetermined distance, lower ends of groove partition walls 14 are positioned out of the upper surfaces of protrusions 16 which are placed into engaging recessed portions 23 so that lower ends of groove partition walls on the grooved plate 15 contact to the surface of the substrate 12 as shown FIG. 8. After the grooved plate 15 is further moved so that electro-thermal energy conversion elements 11 are located at centers between two neighboring groove partition walls 14 (as shown in FIG. 2). After the grooved plate is finely adjusted its position against the substrate 12, two plates are fixed together by a clip (not shown in figures) or adhesives.

Though the depths of engaging recessed portions 23 are set larger than the heights H of protrusions 16, it is necessary to set the depths of engaging recessed portions more deeper by the amount corresponding to thickness of protecting layers the micro processed portions for enhancing the performance formed on electro-thermal energy conversion elements 11. It is also necessary to set a dimensional relation between electro-thermal conversion elements 11 and its two neighboring groove partition walls 14 so as to avoid lower ends of groove partition walls 14 from being mounted on electro-thermal energy conversion elements 11, when lower ends of groove partition walls 14 on the grooved plate 15 slip out of upper ends of protrusions 16. Hereinafter the dimensional relation is explained by referring FIG. 9. In the figure, $P_1$ is spacing between two neighboring liquid paths 13, namely spacing for electro-thermal energy conversion elements 11, $P_2$ is a distance between the protrusion 16 and the neighboring electro-thermal energy conversion element 11, w is a width of the electro-thermal energy conversion element 11, θ is an inclined angle of the groove partition wall which parts the engaging recessed portion 23, $m_1$ is a width of the lower end of the groove partition wall adjacent to the engaging recessed portion 23 and $m_2$ is a width of the lower end of the groove partition wall. When lower ends of groove partition walls 14 on the grooved plate 15 slip out of upper ends of protrusions 16, the dimensional relation should satisfy the following equation in order to avoid lower ends of groove partition walls 14 from being mounted on electro-thermal energy conversion elements 11;

$$0 < P_1 - m_2 + m_1 + (H-h)\tan\theta - (P_2 + w/2) \leqq (P_1 - w - m_2)/2.$$

Figure 10:
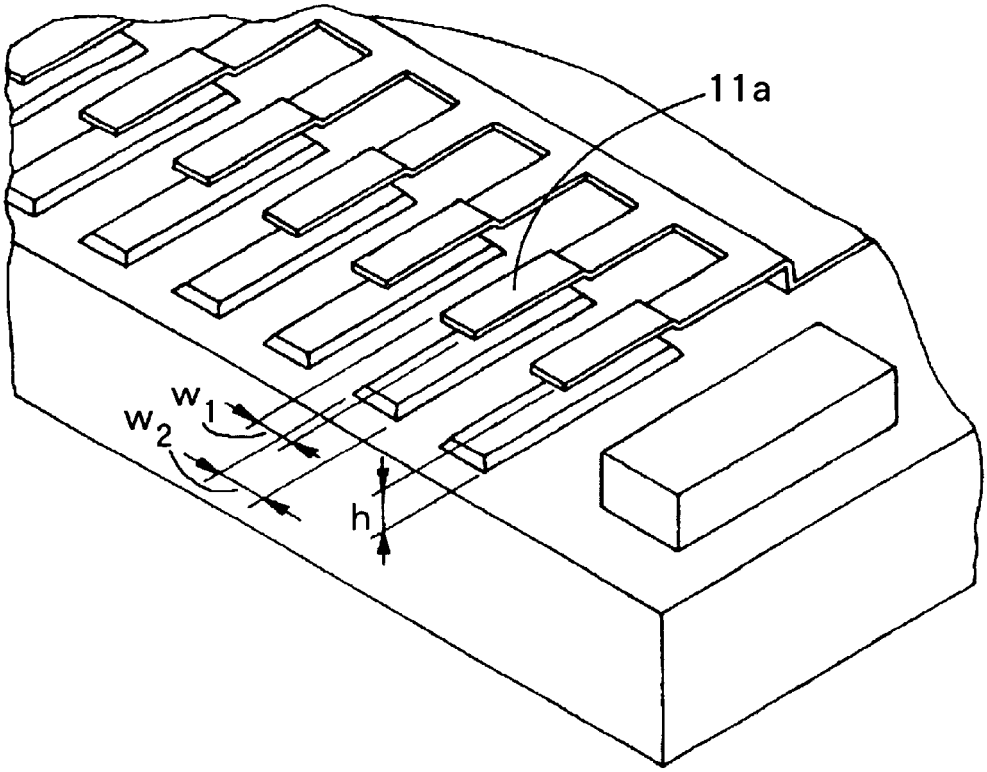
FIG. 10 is a perspective view of the substrate of a second embodiment where the liquid eject head is applied to the ink-jet head according to the present invention.

When the protecting layer or micro processed portions for enhancing the performance such as reed valves are formed on electro-thermal energy conversion elements 11, it is necessary to consider the height from the substrate 12 to upper ends of reed valves. In FIG. 10 the other embodiment where such micro processed portion is schematically depicted, where the same signs indicating parts or members as the preceding figures are used. In the figure a micro processed portion 11*a* is formed above the electro-thermal energy conversion element 11 in a laminated state, where a height h of the micro processed portion 11*a*, from the upper end of the micro processed portion 11*a* to the surface of the substrate 12, is set higher than the height of the electro-thermal energy conversion element 11 from the surface of the substrate 12 to the upper end of the electro-thermal energy conversion element 11. Therefore, in this case the distance from the upper end of the micro processed portion to the surface of the substrate 12 is employed as the height h. When the width $w_1$ of the micro processed portion 11*a* is smaller than the width $w_2$ of the electro-thermal energy conversion element 11, the width $w_2$ of the electro-thermal element 11 is used as w in the equation. On the contrary when the width $w_1$ of the micro processed portion is larger than the width $w_2$ of the electro-thermal energy conversion element 11, the width $w_1$ of the micro processed portion 11*a* is used as w in the equation.

As described above, when the micro processed portion 11*a* is formed further above from the surface of the substrate 12 than electro-thermal energy conversion elements 11, the height h is set the height from the surface of the substrate 12 to the upper end of the micro processed portion 11*a* and w is set a larger width out of respective widths w1, w2 of the micro processed portion 11*a* and the electro-thermal energy conversion element 11.

The positioning between the substrate 12 and grooved plate 15 along the longitudinal direction of liquid paths 13 is attained by pressing the eject port plate 22 of the grooved plate 15 against the substrate 12.

Figure 6:
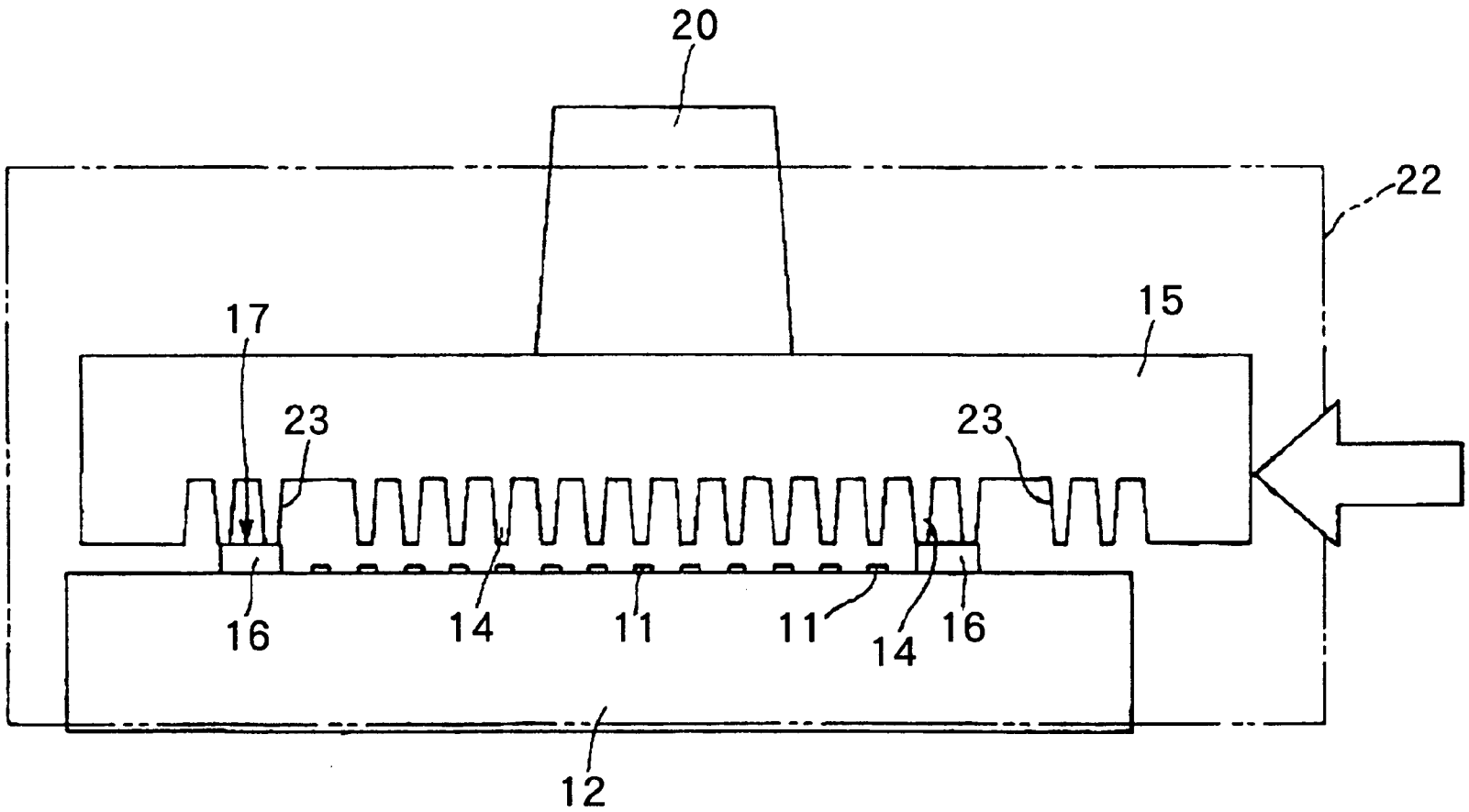
FIG. 6, FIG. 7 and FIG. 8 are illustrating assembling procedures of the ink-jet head in FIG. 1.

When the grooved plate 15 is moved from the position shown in FIG. 6 to the position shown in FIG. 2, the grooved plate 15 may be moved parallel along the surface of the substrate 12 without pressing the grooved plate 15 against the surface of the substrate 12. Since lower ends of groove partition walls 14 do not contact to electro-thermal energy conversion elements 11 during the movement of the grooved plate 15, electro-thermal energy conversion elements 11 are perfectly free from damages caused such movements and damages or deformations of the lower end of groove partition walls 14 are kept minimum.

In the embodiment explained above, the positioning between the substrate 12 and the grooved plate 15 is executed along the aligned direction of electro-thermal energy conversion elements 11 by engaging two pairs of protrusions 16 with engaging recessed portions 23, but more than three pairs of the protrusions 16 and engaging recessed portions 23 arranged with a certain distance each other may be also used for that purpose.

Embodiment 2

Figure 11:
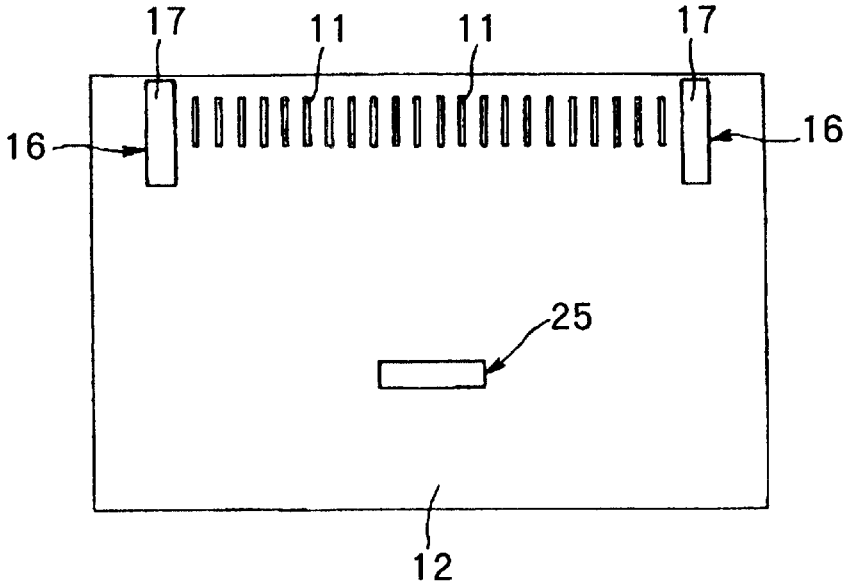
FIG. 11 is a perspective of the substrate of a third embodiment where the liquid eject head is applied to the ink-jet head according to the present invention.
Figure 12:
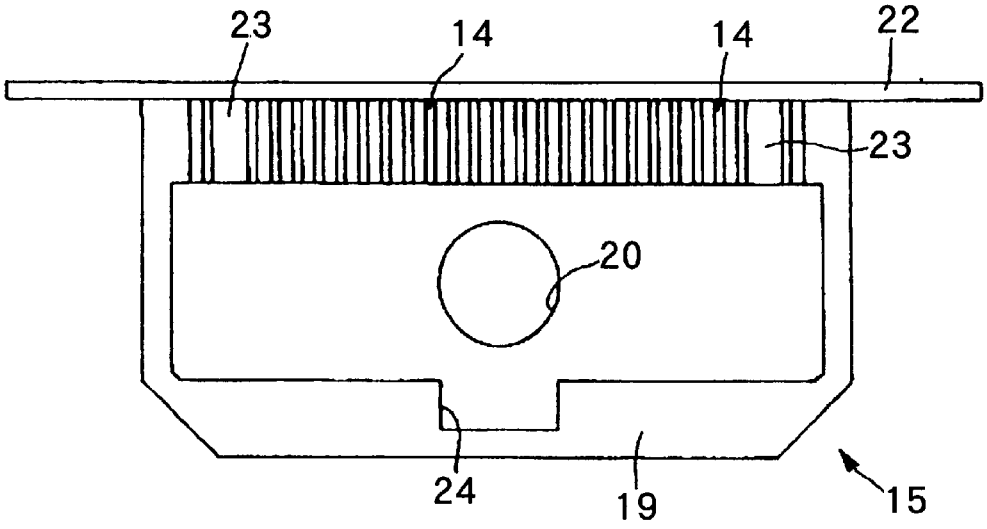
FIG. 12 is a rear view of the grooved plate to be engaged to the substrate in FIG. 11.
Figure 13:
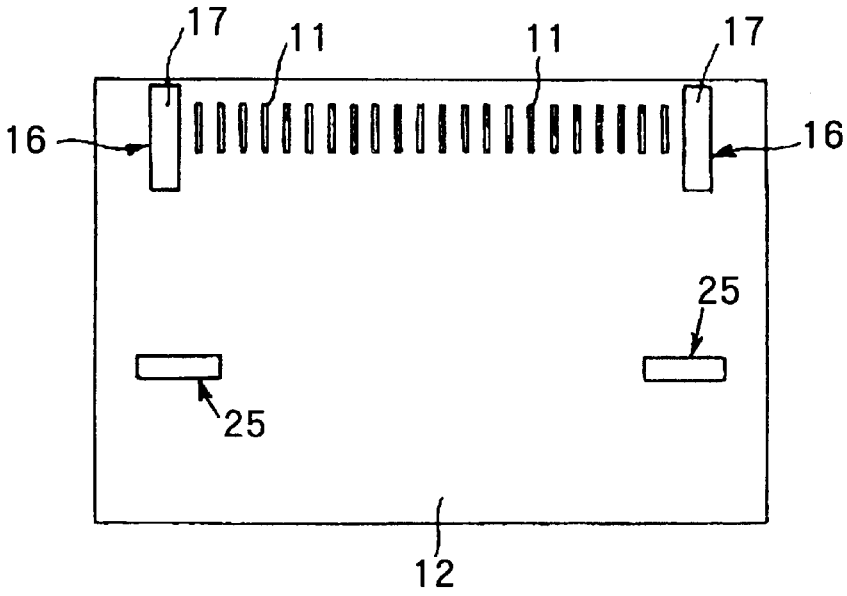
FIG. 13 is a plan view showing a fourth embodiment where the liquid eject head is applied to the ink-jet head according to the present invention.
Figure 14:
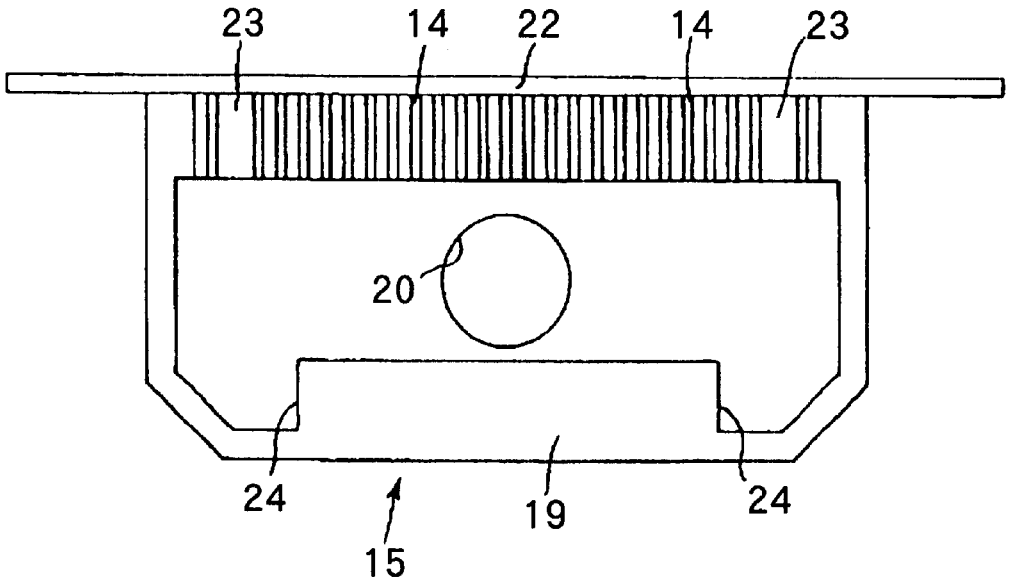
FIG. 14 is a rear view of the grooved plate to be engaged with the substrate in FIG. 13.

Plan views of substrates of the second and the third embodiments are shown in FIG. 11 and FIG. 13 and corresponding rear views of the grooved plates are shown in FIG. 12 and FIG. 14, where the same signs are used in the same parts or members as in the FIG. 1. In the second embodiment depicted in FIG. 11 and FIG. 12, an additional engaging recessed portion 24 is formed by cutting a portion of the liquid chamber frame 19 and a corresponding protrusion 25 for engaging is formed on the substrate 12.

In the second embodiment since the grooved plate 15 is supported by three protrusions 16 and 25 when the grooved plate 15 is placed on the substrate 12, more stable movement of the grooved plate 15 may be attained. Since three engaging positions are arranged, an inclined status of the grooved plate 15 against substrate 12 along the longitudinal direction of groove partition walls 14 may be kept smaller than the first embodiment so that the more precise positioning may be realized.

Embodiment 3

In the embodiment 3 shown in FIG. 13 and FIG. 14, combinations of the above mentioned engaging recessed portions 24 and protrusions 25 are arranged in two pairs, where more precise positioning than the preceding embodiments is attained.

In the embodiments shown in FIG. 11 to FIG. 14, even when the grooved plate 15 having engaging recessed portions 23 and 14 is moved to the position where corresponding protrusions 16 and 25 on the substrate 12, no troubles such that lower ends of groove partition walls 14 contact to electro-thermal energy conversion elements 11, are caused. The substrate 12 in these embodiment has a rectangular shape 15 mm by 4 mm.

Embodiment 4

FIGS. 15A to 15E are schematic views illustrating how to determine dimensions of protrusions formed on the substrate 12 having electro-thermal energy conversion elements 11 in the ink-jet head manufacturing method according to the present invention.

In these figures the same signs are used in the same parts or members in the preceding embodiments. A character "d" in these figures is an offset value at a time when the grooved plate 15 is placed on the substrate 12 where electro-thermal energy conversion elements 11 are arranged, Δd is a dispersion value of the offset value d and W is a width of protrusions in the aligned direction of electro-thermal energy conversion elements 11 formed on the substrate 12.

Figure 15A:
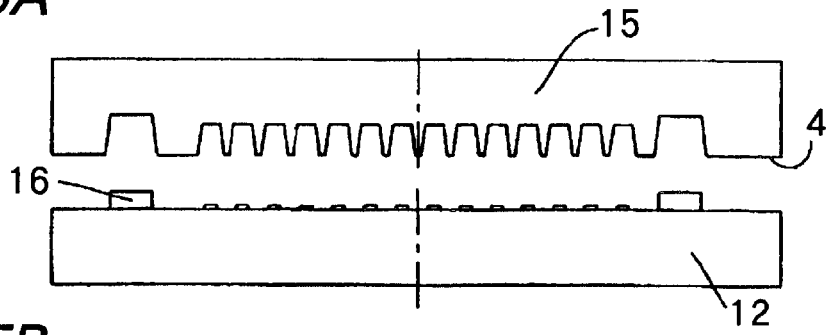
FIGS. 15A to 15E are schematic views showing supplying relations between protrusions on the substrate and engaging recessed portions on the grooved plate in a fifth embodiment.

FIG. 15A illustrates a finished state of the positioning between the substrate 12 having electro-thermal energy conversion elements 11 and grooved plate 15 having liquid paths, which means the offset value d is zero.

Figure 15B:
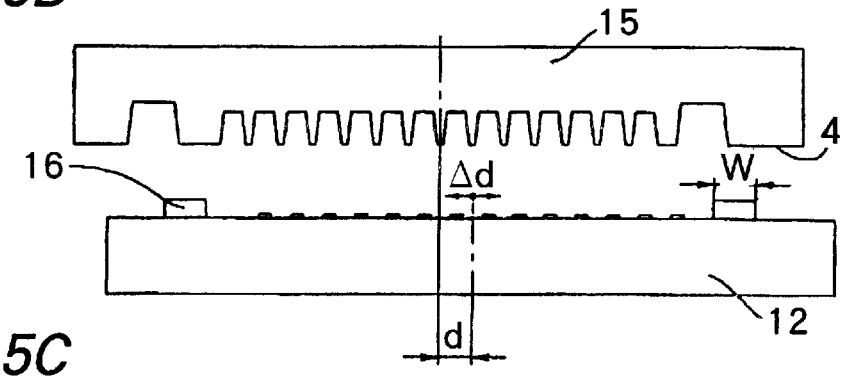

FIG. 15B illustrates a state where the grooved plate 15 is placed on the substrate in a displaced state by the offset value d. In this case, the placed position of the grooved plate fluctuate according to the accuracy of the apparatus or parts. When the positioning accuracy is defined as ±Δd , a relation between the width W of the protrusion 16 on the substrate is expressed by the following equation.

$$W \geqq d+|\Delta d|$$

Figure 15C:
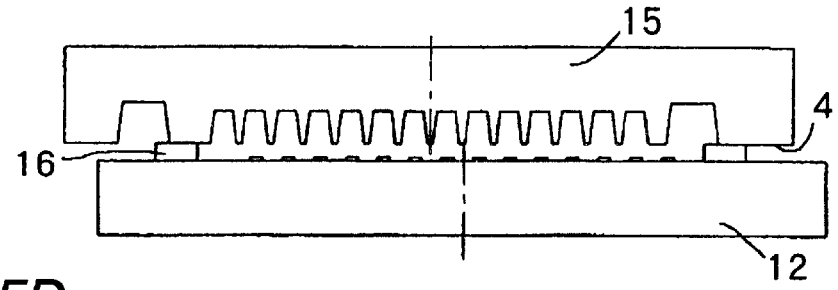

FIG. 15C illustrates a state where the grooved plate 15 is placed on the substrate 12 having protrusions 16 with width W in a displaced state by the offset value d. In this case the value of the accuracy Δd is set zero.

Figure 15D:
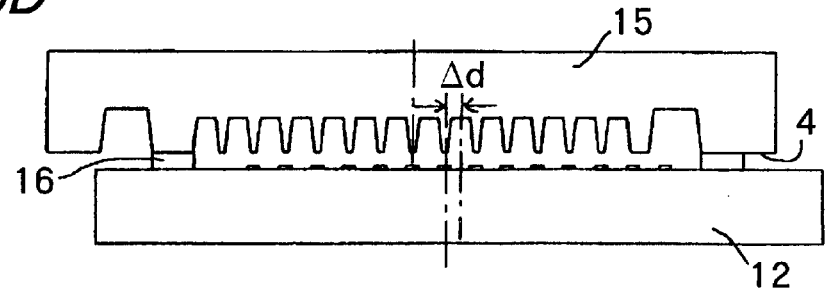

FIG. 15D illustrates a state where the substrate 12 is supplied in a displaced state with the accuracy Δd (rightward displacement). Here when the width W of the protrusion 16 satisfies; $W=d+|\Delta d|$, protrusions 16 are not located beyond left sides of accepting surfaces 4. In this embodiment the substrate is moved in the leftward direction, but it may also be moved in the rightward direction, in accordance with the arrangement or the geometry between the substrate and the grooved plate.

Figure 15E:
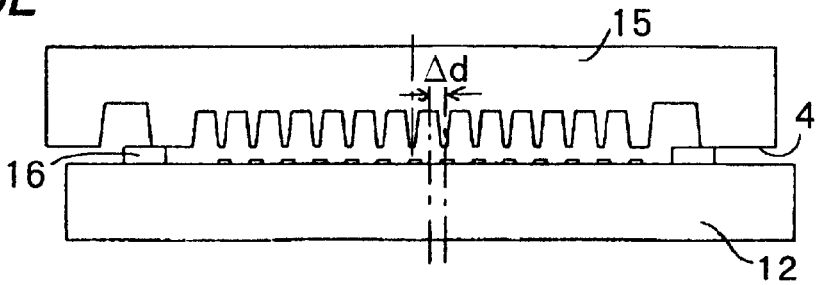

FIG. 15E illustrates a state where the substrate 12 is supplied in a displaced state with accuracy —Δd (leftward displacement). Even in this case the accepting surfaces 4 still hold the protrusions 16 of the grooved plate 15.

In this embodiment the groove plate is set as the reference against the substrate for positioning, it is also possible the substrate is set as the reference in accordance with the arrangement or the geometry between the substrate and the grooved plate.

Figure 16A:
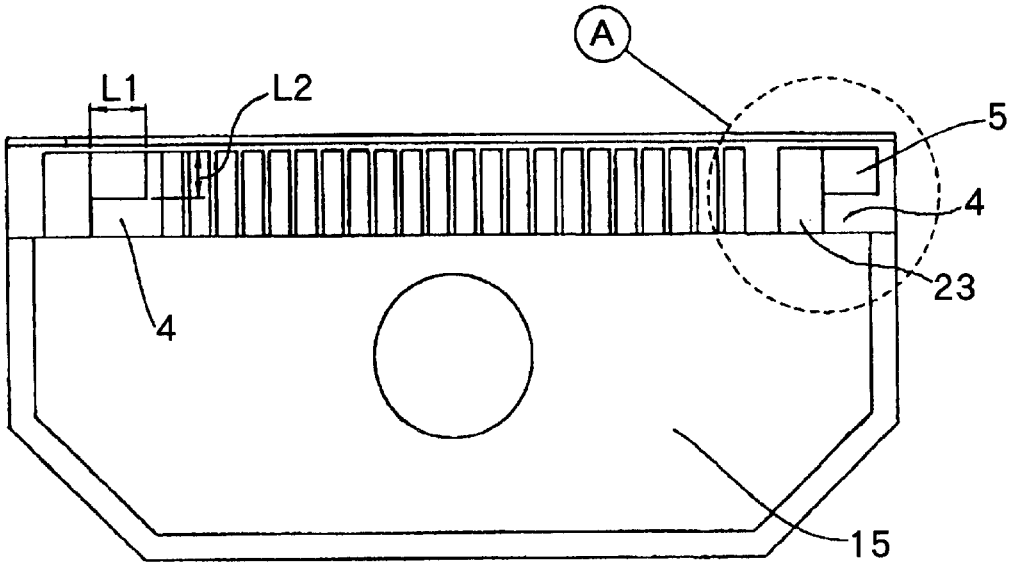
FIGS. 16A and 16B show the rear side of the grooved plate in FIG. 15 where
Figure 16B:
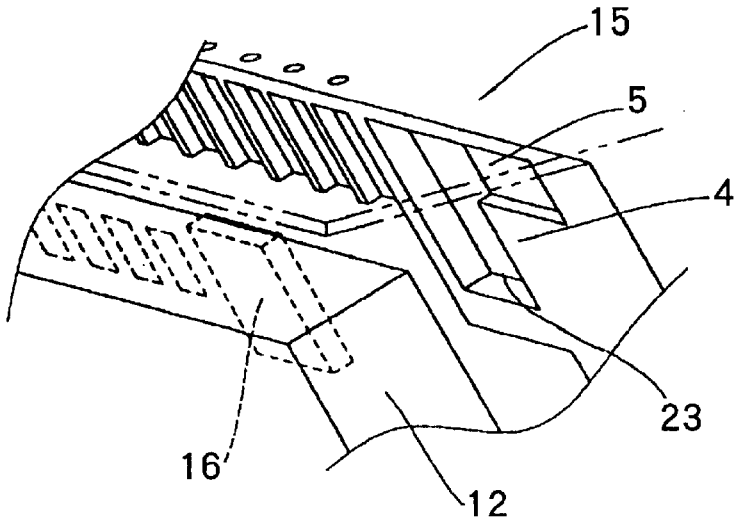

FIGS. 16A and 16B show rear views of the grooved plate illustrating dimensions of concave portions of the accepting surfaces 4. A numeric character 5 in these figures is the concave portions on accepting surfaces: 4. L1 is a width of concave portions 5 in the aligned direction of liquid paths and L2 is a length of concave portions 5. L1 should be determined so as to satisfy the following equation;

$$L1 \geqq W$$

When the substrate 12 is supplied against the grooved plate 15 (or vice versa), it is also placed in offset states in the ejecting direction as is placed in the aligned direction of liquid paths. Consequently, the dimension of the concave portion 5 in the ejecting direction should be larger than a value of offset and its accuracy combined.

In the same manner the protrusion 16 also keeps its side end in the ejecting direction within a dispersion value namely within the surface 4 and within a boundary surface of the concave portion 5 when the grooved plate 15 is supplied along the ejecting direction.

Figure 17:
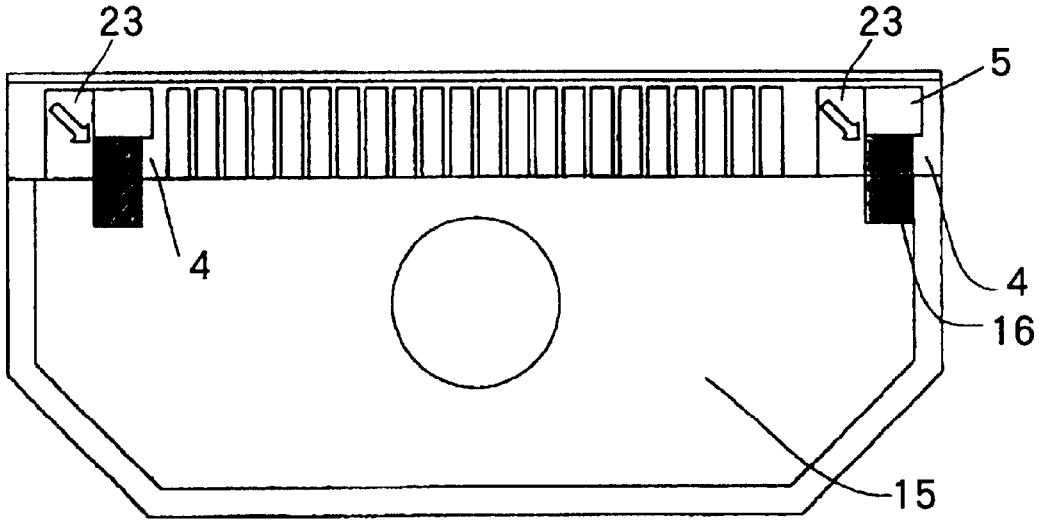
FIG. 17 is a schematic view illustrating a relation between a receiving surface of the grooved plate and protrusions on the substrate at maximum allowance for engaging.

FIG. 17 is a schematic view illustrating a relation between the accepting surfaces 4 and protrusions 16 when the substrate 12 and grooved plate 15 are. supplied in the offset state with maximum displacement in the ejecting direction. When the width W=d+|Δd| of protrusions 16 satisfy the relations with L1 and L2 in FIG. 16; L1≧W, L2=W, protrusions 16 are not out of accepting surfaces 4 even in a state where the offset substrate is displaced against the grooved plate within the accuracy in a direction shown arrows in the figure. As explained it is necessary to keep protrusions 16 within the offset value and the length of concave portions 5 is set equal to or larger than the width W of protrusions 16.

In this embodiment since the offset value is 0.0075 mm with accuracy ±0.025 mm at the supplying time, the width of the protrusion 16 should be W≧0.1 mm, consequently, the value of W is set 0.12 mm. Dimensions for the concave portion 5 are set as follows: L1=0.15 mm, L2=0.12 mm.

Embodiment 5

FIGS. 18A to 18D are schematic views illustrating deformation and moving procedures of the grooved plate 5 when the substrate 12 and grooved plate 15 are supplied for the positioning as the embodiment 4 in a manufacturing method of the ink-jet head.

In this embodiment only a case where the grooved plate 15 is supplied against the substrate 12 as the reference is described. However, Either the grooved plate 15 or the substrate 12 is selected as the reference.

Figure 18A:
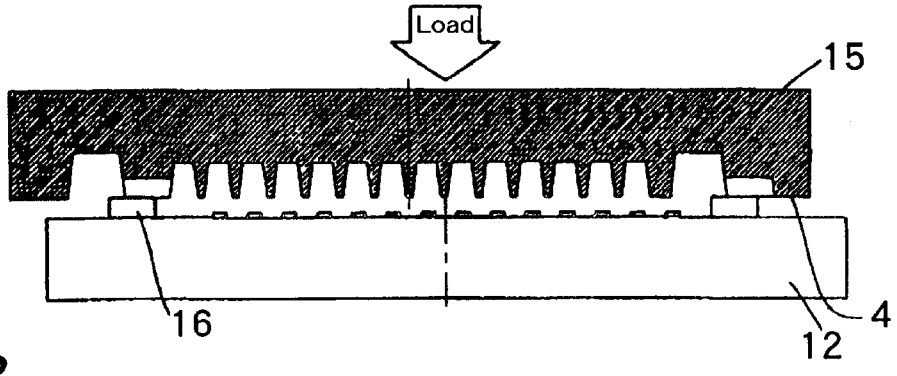
FIGS. 18A to 18D are a schematic view of a fifth embodiment where a positioning of the grooved plate to the substrate is carried out by applying a load.

In FIG. 18A the grooved plate 15 is supplied against the substrate 12 where accepting surfaces 4 of the grooved plate 15 are mounted on protrusions 16 on the substrate 12. At this stage the above-mentioned accepting surfaces 4 are positioned equal to or beyond the left side of protrusions 16. The grooved plate 15 is clamped under a load so as to prevent the grooved plate 15 from abrupt displacement during moving the grooved plate 15 for the positioning.

Figure 18B:
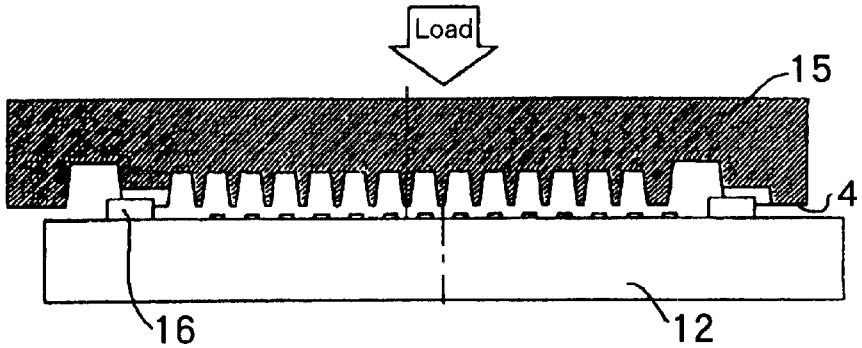

FIG. 18B shows a status of the grooved plate 15 where the accepting surfaces 4 accepting protrusions 16 are deformed due to the clamped force when the grooved plate 15 is formed out of soft materials such plastics.

Figure 18C:
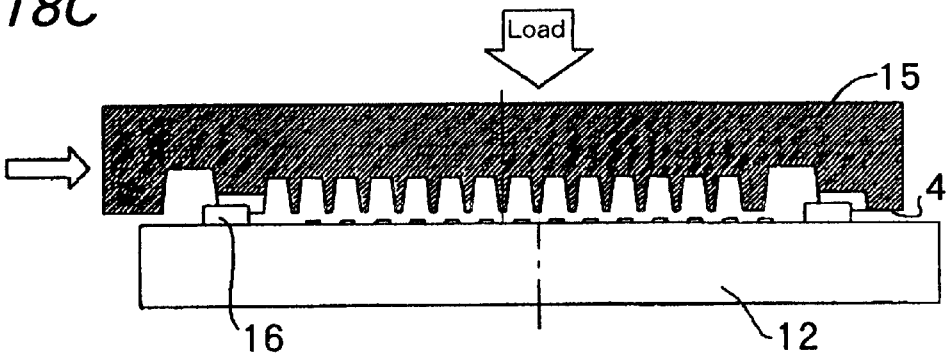

FIG. 18C shows the positioning by keeping the deformed status of the accepting surfaces 4 shown in FIG. 18B. The grooved plate 15 is moved in the direction depicted by an arrow at the left side in the FIG. 18C so as to engage the reference position (not shown) of the grooved plate 15 to the reference position (not shown) on the substrate 12.

Figure 18D:
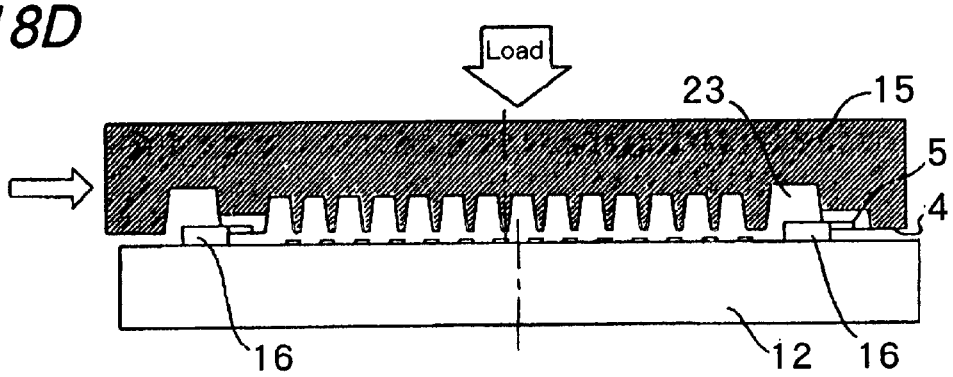

FIG. 18D shows a status during the movement of the grooved plate 15. Since the left sides of protrusion 16 are located beyond left sides of accepting surfaces 4, accepting surfaces 4 are deformed due to the load for the clamping. Even when accepting surfaces 4 are deformed, moving the grooved plate 15 is executed smoothly since accepting surfaces may be deformed without difficulties.

Also it is necessary to move the grooved plate 15 in the ejecting direction (i.e. from an upper plane of the figure to the plane of this figure) for the positioning of the grooved plate 15 against eject port surface of the substrate 12. However, since concave portions (not shown) are formed on accepting surfaces 4 in the ejecting direction, a smooth movement of grooved portions may possible due to the easy deformation of accepting surfaces 4.

The depth of the concave portion should be set larger than the deformed amount of accepting surfaces 4, which is determined by the material of the grooved plate 15 and the load. However, it is necessary to adjust the load and the height of protrusions 16 in accordance with the warped amount of the grooved plate 15. When the micro processed portions is formed over the electro-thermal energy conversion element 11, it is also necessary to consider the height of the micro processed portion.

In this embodiment, specific values for respective items explained above are as follows. The height of the micro processed portion: 0.01 mm, the warped amount of the grooved plate: 0.01 mm concave toward the substrate 12, the clamping load during the supply: 130 g, the clamping load during the movement: 40 g, the width of the protrusion: 0.12 mm, the height of the protrusion: 0.035 mm, the width, length and depth of the concave portion: 0.15 mm, 0.12 mm and 0.024 mm respectively and offset amount with accuracy: 0.075 mm±0.025 mm where plastics are used as materials for the grooved plate. Since the deformed value of the accepting surface fluctuates between 0.001 mm to 0.007 mm, namely within the dispersion values (±0.0025 mm), the deformation under the load of 40 g during movement is almost impossible to detect and the movement is executed smoothly with the positioning accuracy ±0.0003 mm.

In this embodiment, the load is applied downwardly to the grooved plate, but it may be applied upwardly to the substrate 12. As the positioning method, any of the following methods is used; An image processing method (non-contact method) to recognize the reference positions where the plates are moved until the reference positions meet each other, A method where the side face of the substrate is fitted to the reference surface of the grooved plate, a method where protrusions on the substrate are fitted to the reference positions of the grooved plate and other conventional methods.

Figure 19:
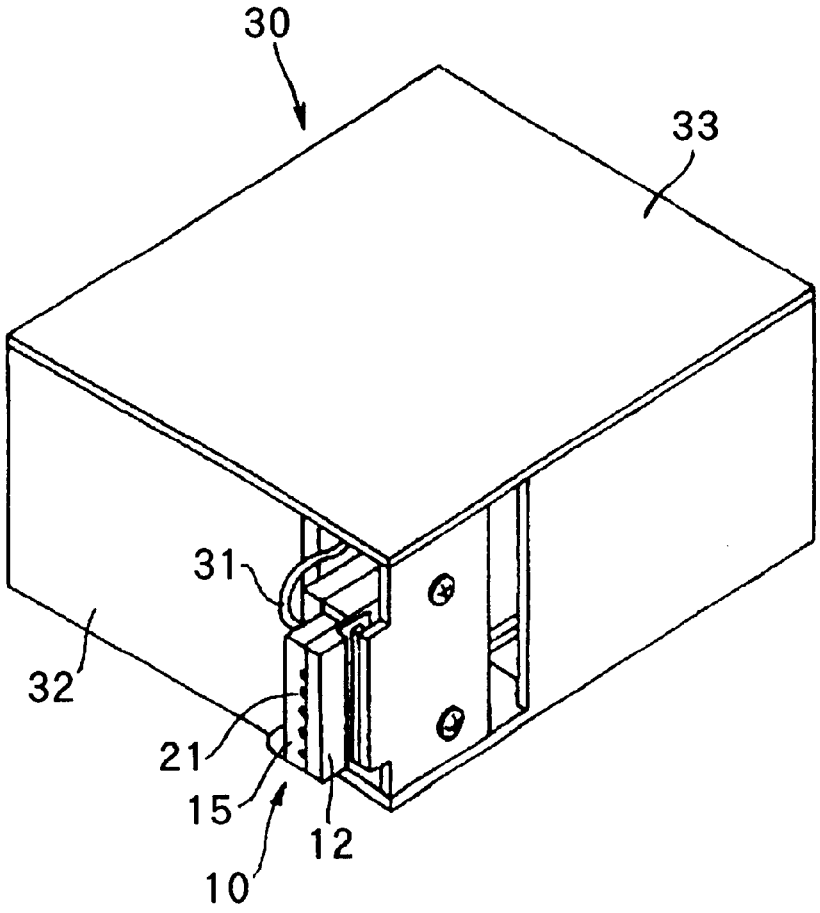
FIG. 19 is a perspective view illustrating an appearance of an embodiment equipped with the cartridge according to the present invention.

FIG. 19 is a perspective view showing an embodiment of a cartridge equipped with an ink-jet head 10 manufactured in the above-described way according to the present invention. The cartridge 30 according to the present invention for serial printers comprises the ink-jet head 10, a liquid supplying pipe 31, a liquid tank 32 for storing liquid such as ink and a cover plate 33 for tightly closing the liquid tank 32.

The ink-jet head 10 where a plurality of eject ports 21 for ejecting liquid are formed, is manufactured according to the embodiments described in FIG. 1 to FIG. 18D, where the liquid is guided from the liquid tank 32 via liquid supplying pipe 31 to the unshown common liquid chamber formed by the substrate 12 and grooved plate 15.

Though the cartridge 30 in this embodiment is formed in one piece where the ink-jet head 10 and the liquid tank 32 are combined, it is also possible to make the liquid tank 30 exchangeable and connected to the ink-jet head 10.

Figure 20:
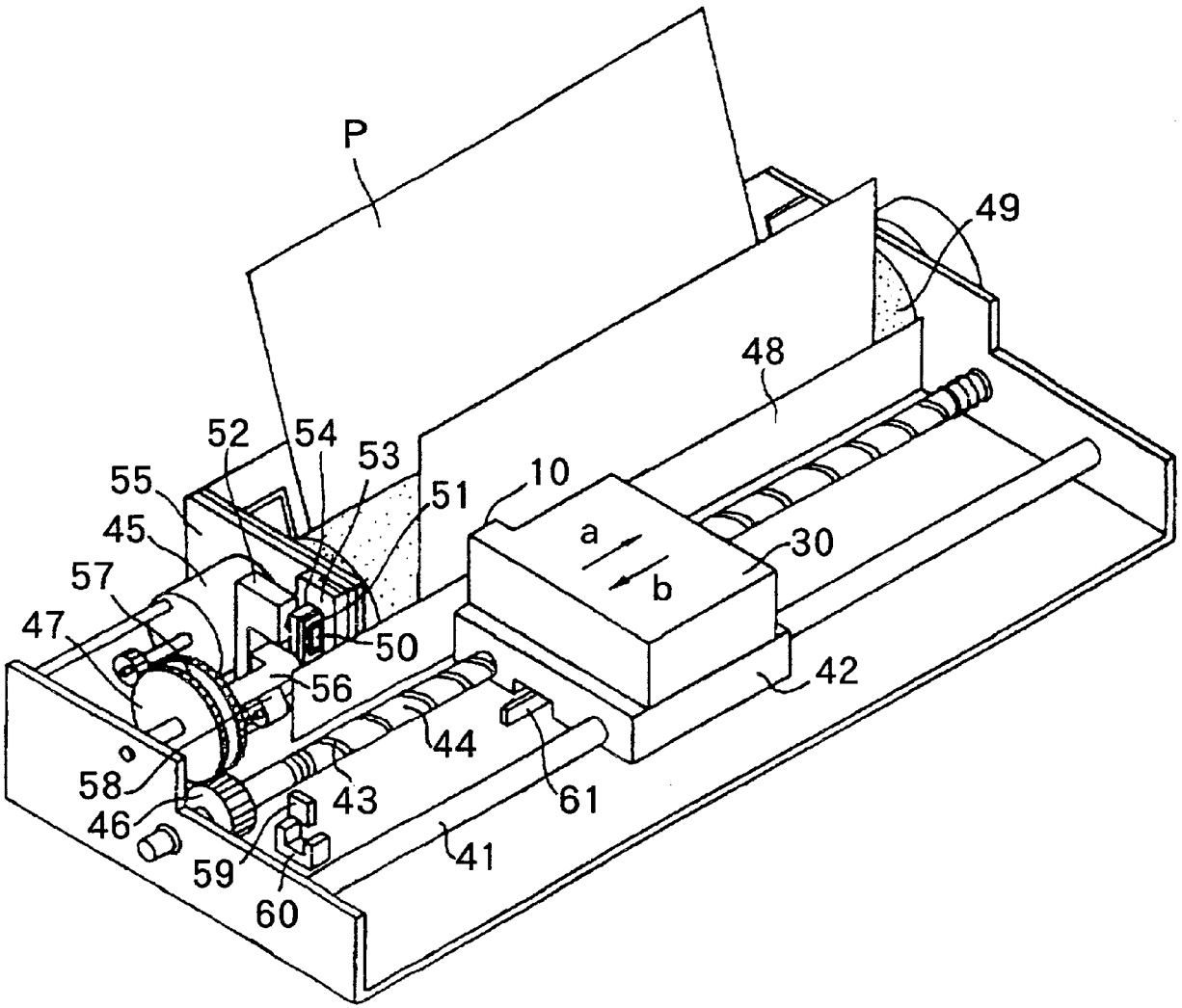
FIG. 20 shows an embodiment in an image forming apparatus to which a serial printer is applied.

FIG. 20 is a perspective view illustrating an ink-jet apparatus where the above-mentioned cartridge is mounted according to the present invention. A numeric character 41 is a guide axis for guiding a carriage 42 in an arrow "a" or arrow b direction. A numeric character 43 is a screw groove formed on a conveying screwed bolt 44. The carriage 42 moves along the guide axis 41 in the arrow "a" or "b" direction in accordance with the forward or reverse rotation of the conveying screwed bolt 44. Printing is executed on area for printing of a printing paper P as a printing medium by the movement of the ink-jet head 10 of the cartridge 10 mounted on the carriage 42.

A numeric character 45 is a carriage driving motor. Numeric characters 46 and 47 are gears for transmitting the driving force from the carriage driving motor 45. A numeric character 48 is a sheet pressing plate for pressing the printing paper P against a platen 49. In this embodiment the following members are equipped with the ink-jet apparatus; an opening 50, a cap member 51 for covering the eject port plate 22 (see FIG. 1) of the ink-jet head 10, sucking means 52 connected to the cap member 51 for sucking liquid via the cap member 51 from the ink-jet head 10 during ink recovery operation, a cleaning blade 53 used before and after the recovery operation and a supporting member 54, where the cleaning blade 53 is moved in the direction shown by the arrow via a supporting member 55 of the cleaning blade for wiping the surface of the eject port plate 22.

A numeric character 56 is a lever for driving the sucking means 52 via the gear 57 and a cam 58 so that these three members comprise a transmitting means. During sucking operations the driving force from the carriage driving motor 45 is transmitted to the sucking means 52 via a clutch (not shown) and the transmitting means. Numeric characters 59 and 60 are photo couplers for detecting the home position of the carriage 42, on which a protruding lever 61 for detecting the home position of the carriage by interrupting a light path so as to switch rotating directions (forward or backward) of the carriage driving motor 45.

In this embodiment though the capping, the cleaning and the sucking for ink recovery are arranged so as to be executed by driving the transmitting axis 44 when the carriage 42 is located at home position, any other arrangements are used as far as these operations are activated at proper timings.

The present invention realizes its most excellent performance in an ink-jet type image forming apparatus where energy generating means (such as electro-thermal energy conversion element, laser light etc.) for generating energy so as to change phase of the liquid and to eject liquid are arranged. Thus, excellent printing results with high density, finer and more precise quality are obtained.

It is preferable to apply the basic principle disclosed, for example, in the U.S. Pat. Nos. 4,723,129 and 4,740,796 to the present invention. Although the principle is applicable either to "on demand type" or to "continuous type", particularly it is more effective to the on-demand type, since the thermal energy is generated to cause a nuclear boiling on the surface of the thermal energy: generating means arranged against liquid paths of the liquid eject heads where the liquid is held, namely to cause a film boiling on surfaces of liquid eject heads, by applying at least one driving signal, according to information to be printed. Which, as a result, is effective, since bubbles are formed in the liquid in accordance with respective driving signals. The liquid is ejected via the eject ports and is form at least one droplet by a cycle of growing and shrinking movements of bubbles. Pulse driving signals are more favorable since more responsive liquid ejection is attained due to a quick and proper cycle of growing and shrinking movements of bubbles. Pulse driving signals disclosed in the U.S. Pat. Nos. 4,463,359 and 4,345,262 are suitable as the signals mentioned above. When the conditions disclosed in the U.S. Pat. No. 4,313,124 relating to temperature increasing rate on the surface of the energy generating means, are applied, more excellent printing quality is realized.

Except arrangements disclosed in the above-referred U.S. patents combining eject ports, liquid paths and electro-thermal energy conversion elements (the straight liquid flow path where electro-thermal energy conversion elements are arranged along liquid path or perpendicular liquid flow path where electro-thermal energy conversion elements are arranged at the opposite side of eject ports with respect to liquid path), arrangements disclosed in the U.S. Pat. Nos. 4,558,333 and 4,459,600 where energy generating members are arranged at curved areas of liquid paths may be employed in the present invention. In addition, the arrangement disclosed in the Japanese laid open patent No. 59-123670 where common slits are shared among a plurality of electro-thermal energy conversion elements as eject ports and the arrangement disclosed in the Japanese laid open patent No. 59-138461 where openings to absorb pressure wave from thermal energy are arranged against eject portions are also effectively employed in the present invention. In other words, the present invention realizes reliable and effective printings, regardless of arrangements of liquid eject heads.

The present invention may be effectively applied to a full line type liquid eject heads having a length corresponding to maximum width of a printing medium on which an image forming apparatus prints images. The full line type liquid eject heads are obtained by combining a plurality of liquid eject heads to fulfill the required width or by a liquid eject head formed in one piece.

A solid liquid eject head fixed to the carriage which moves reciprocatingly, a tipped liquid eject head demoutably mounted on the carriage where electrical connections to the apparatus and liquid supply from the apparatus are attained or a cartridge where a liquid eject head and a tank for storing liquid are formed in one piece, is also effectively employed in the above-mentioned serial type printer.

It is preferable to add auxiliary means to the arrangement of the image forming apparatus, since effects according to the present invention are enhanced more. More specifically, the auxiliary means may be the capping means and a cleaning means for the liquid eject head, pressure application means or the sucking means, auxiliary heating means used together with the electro-thermal energy conversion means or other heating elements, or a combination of them and auxiliary eject means used except printing etc.

Except a printing apparatus having one mono color liquid eject head, the present invention is quite effectively used in printing apparatuses having at least one of the following functioned liquid eject heads; printing modes to select a plurality of colors or mixed colors for full color printing. In other words, as printing modes for an image forming apparatus not only main color such as only black printing mode, but also a plurality of colors or mixed colors for full color printing mode is quite effective to the present invention any arrangements whether the liquid eject head is formed in one piece or a combination of several heads. It is effective to eject print adjusting liquid (printing quality enhancer) from the common liquid eject heads or an exclusive eject head for adjusting printing quality according to kinds of printing media and printing modes.

In the embodiment of the present invention mentioned above, ink which solidifies at or less than room temperature and softens or melts at room temperature, may be used. Or since usually in ink-jet printings liquid temperature is controlled between 30° C. and 70° C. so as to keep liquid viscosity suitable for stable ejection, ink which liquefied when signals are applied, may be also used. In addition, ink which is solid at room temperature but is liquid when heated may be used, since temperature rising in ink and as a result evaporation of the ink is suppressed by a phase change where generated thermal energy is used for the phase change from a solid state to a liquid state. Any ink with a property liquefied for ejecting only when thermal energy applied, such as ink liquefied by applied thermal energy in accordance with printing signals, ink that starts solidifying just when it is deposited on printing media may be used. The liquid bearing above-mentioned properties may be used in ways disclosed in the Japanese laid open patents No. 54-56847 and No. 60-71260 where ink is stored in the solid or liquid form in concave pits or through holes of the porous sheet arranged so as to face against electro-thermal energy conversion elements. In the invention the film boiling method is the most effective for the above-mentioned liquids.

The image forming apparatus according to the present invention is used not only as an image outputting terminal for an information processing unit such as a computer and the like, but also a copying device combined a reading device, a facsimile equipped with transmitting/receiving functions and a textile printing apparatus etc. Sheet formed or extending paper and cloth, or wood, stone, plastic, glass and metal in sheet form, or further a 3-dimensionally structured body may be used as the printing medium.

According to the present invention since at least two protrusions formed on the substrate apart each other and corresponding engaging recessed portions formed on the grooved plate for engaging the above-mentioned protrusions, wherein a height from the surface of the substrate to upper ends of the above-mentioned protrusions is set higher than a height from the surface of the substrate to upper ends of the above-mentioned micro processed portions, positioning of the grooved plate against the substrate is safely executed by mounting the grooved plate on upper ends of protrusions, by moving the grooved plate along upper ends of protrusions and finally by engaging protrusions with the engaging recessed portions. Consequently, the liquid eject head is assembled without causing any damages or deformation on the micro processed portion including eject energy generating elements and the grooved plate.

Since the precise and easy positioning the grooved plate against the substrate where micro processed portions including eject energy generating elements are formed is carried out by utilizing conventional manufacturing facilities with little modifications, the liquid eject head with high quality is manufactured at low cost.

Particularly when protrusions are formed outside the aligned row of eject energy generating elements, the breakage or deformation of eject energy generating elements are prevented without fail. When a recessed portion communicated to the opposite side of eject ports as common liquid chamber formed on the grooved plate is used as the engaging recessed portion, the two dimensional positioning the grooved plate to the substrate is carried out more precisely.

When upper ends of protrusions are formed as flat surfaces parallel to the surface of the substrate, the grooved plate is stably mounted on these flat ends.

When a force is applied to the grooved plate in a direction almost parallel to the substrate so as to move the grooved plate, deformations of the grooved plate are kept minimum.

When engaging recessed portions are engaged with protrusions by utilizing weight of the grooved plate, damages and deformations of the grooved plate are kept minimum.

Other embodiment according to the present invention is effective as follows.

Since the structure of the grooved plate having liquid paths is arranged to avoid unnecessary external force, assembling the ink-jet head is carried out without damaging or deforming liquid paths.

Even the micro processed portions are formed on the substrate, the ink-jet head may be assembled without giving any bad effects on the micro processed portions when the method according to the present invention is employed.

Since the precise and easy positioning the grooved plate against the substrate where micro processed portions including eject energy generating elements are formed is carried out by utilizing conventional manufacturing facilities with little modifications, the liquid eject head with high quality is manufactured at low cost.

When the grooved plate having liquid paths and the substrate having energy generating elements are clamped together, the grooved plate having liquid paths is deformed by protrusions formed on the substrate where energy generating elements are arranged. Even when protrusions on the substrate are bitten into the grooved plate where liquid paths are formed, the positioning is executed in the conventional ways without strengthening protrusions, lowering the clamped force to avoid protrusions from biting into the grooved plate or increasing force to move the grooved plate.

What is claimed is:

1. A liquid eject head comprising:

a substrate having a plurality of eject energy generating elements for ejecting liquid droplets, a plurality of micro processed portions including said eject energy generating elements, and a first surface on which the plurality of said micro processed portions are arranged, and a grooved plate having a plurality of eject ports for ejecting said liquid droplets, a plurality of grooves communicating to a plurality of said respective eject ports for forming liquid paths, and a second surface on which the plurality of said grooves are arranged, wherein;

said first surface and second surface are fitted together so as to keep a state where said respective eject energy generating elements face against corresponding said grooves, said substrate has at least two protrusions;

a width of the protrusions in an arranged direction of said liquid paths being set larger than the width of said liquid path and, a height of the protrusions from said first surface being set higher than a height of said micro processed portions, and said grooved plate has engaging recessed portions for positioning said grooved plate against said substrate by engaging said protrusions with said engaging recessed portions, and a summed up height comprising a height of a wall of said engaging recessed portions from a ceiling of said liquid path and said height of said protrusions, is set larger than a height of partition walls parting said liquid paths from the ceiling of said liquid path.

2. The liquid eject head according to claim 1 wherein: said protrusions are formed on both outsides of the aligned row of said energy generating elements.

3. The liquid eject head according to claim 1 wherein: said grooved plate further comprises other engaging recessed portion as a common liquid chamber formed at the opposite rear side of said grooves on said grooved plate.

4. The liquid eject head according to claim 1 wherein: said protrusion has a flat surface almost parallel to the surface of said substrate.

5. The liquid eject head according to any one of claims 1 to 4, wherein said eject energy generating elements are electrothermal energy conversion elements to generate thermal energy for causing film boiling in the liquid so as to eject the liquid from said eject ports.

6. A cartridge equipped with:

a liquid head comprising;

a substrate having a plurality of eject energy generating elements for ejecting liquid droplets, a plurality of micro processed portions including said eject energy generating elements, and a first surface on which the plurality of said micro processed portions are arranged, and a grooved plate having a plurality of eject ports for ejecting said liquid droplets, a plurality of grooves communicating to a plurality of said respective eject ports for forming liquid paths, and a second surface on which the plurality of said grooves are arranged, wherein;

said first surface and second surface are fitted together so as to keep a state where said respective eject energy generating elements face against corresponding said grooves, said substrate has at least two protrusions;

a width of the protrusions in an arranged direction of said liquid paths being set larger than the width of said liquid path and, a height of the protrusions from said first surface being set higher than a height of said micro processed portions, and said grooved plate has engaging recessed portions for positioning said grooved plate against said substrate by engaging said protrusions with said engaging recessed portions, and a summed up height comprising a height of a wall of said engaging recessed protrusions from a ceiling of said liquid path and said height of said protrusions, is set larger than a height of partition walls parting said liquid paths from the ceiling of said liquid path.

7. The cartridge according to claim 6 wherein: said liquid tank is demoutably mounted to said liquid eject head.

8. The cartridge according to claim 7 wherein: said liquid is a treatment liquid for adjusting ink and/or ejecting ink onto a recording medium.

9. An image forming apparatus equipped with a device for mounting a liquid eject head comprising:

a substrate having a plurality of eject energy generating elements for ejecting liquid droplets, a plurality of micro processed portions including said eject energy generating elements, and a first surface on which said plurality of micro processed portions are arranged; and a grooved plate having a plurality of eject ports for ejecting the liquid droplets, a plurality of grooves communicating respectively with said plurality of eject ports for forming liquid paths, and a second surface on which said plurality of grooves are arranged, wherein said first surface and said second surface are fitted together so as to keep a state where said respective eject energy generating elements face against corresponding said grooves, said substrate has at least two protrusions, a width of said protrusions in an arranged direction of said liquid paths being set larger than a width of said liquid paths, and a height of said protrusions from said first surface being set higher than a height of said micro processed portions, said grooved plate has engaging recessed portions for positioning said grooved plate against said substrate by engaging said protrusions with said engaging recessed portions, and a summed up height comprising a height of a wall of said engaging recessed portions from a ceiling of said liquid paths and the height of said protrusions, is set larger than a height of partition walls parting said liquid paths from said ceiling of said liquid paths.

10. The image forming apparatus according to claim 9 wherein: said device for mounting said liquid eject head has a carriage capable of scanning and moving across a feeding direction of the recording medium.

11. The image forming apparatus according to claim 10 wherein: said liquid eject head is demountably mounted on said carriage via demounting means.

* * * * *

UNITED STATES PATENT AND TRADEMARK OFFICE

CERTIFICATE OF CORRECTION

PATENT NO. : 6,419,347 B2
DATED : July 16, 2002
INVENTOR(S) : Takayuki Ono et al.

It is certified that error appears in the above-identified patent and that said Letters Patent is hereby corrected as shown below:

Column 1,
Line 19, “ends” should read -- end of each --; and
Line 20, “grooves” should read -- grooves, respectively, --.

Column 2,
Line 15, “case” should read -- cases --.

Column 7,
Line 50, “by referring” should read -- with reference to --;
Line 55, “by referring” should read -- using --;
Line 56, “as shown” should read -- as a reference, as shown in --;
Line 61, “status” should read -- state --; and
Line 64, “shown” should read -- shown in --.

Column 8,
Line 2, “walls” should read -- walls 14 -- and “contact to” should read -- contact --.

Column 10,
Line 26, “set” should read -- set to --.

Column 11,
Line 1, “are.” should read -- are --; and
Line 57, “may” should read -- may be --.

Column 12,
Line 49, “b” should read -- “b” --.

Column 13,
Line 35, “energy:” should read -- energy --;
Line 37, “namely” should read -- namely, --;
Line 39, “printed. Which,” should read -- printed, which, --; and
Line 42, “is form” should read -- forms --.

Column 14,
Line 14, “demoutably” should read -- demountably --;
Line 32, “heads;” should read -- heads: --;
Line 37, “any” should read -- in any --; and
Line 38, “arrangements” should read -- arrangements, --.

Column 15,
Lines 27, 39 and 60, “positioning” should read -- positioning of --.

UNITED STATES PATENT AND TRADEMARK OFFICE

CERTIFICATE OF CORRECTION

PATENT NO. : 6,419,347 B2
DATED : July 16, 2002
INVENTOR(S) : Takayuki Ono et al.

It is certified that error appears in the above-identified patent and that said Letters Patent is hereby corrected as shown below:

Column 16,
Line 22, “wherein;” should be deleted;
Line 23, “said” should read -- wherein said --;
Line 27, “protrusions;” should read -- protrusions, -- and close up right margin;
Lines 28 and 31, close up left margin;
Line 30, “path and,” should read -- path, and -- and close up right margin;
Line 33, “and” should be deleted; and
Line 59, “comprising;” should read -- comprising: --.

Column 17,
Line 4, “wherein;” should be deleted;
Line 5, “said” should read -- wherein said --;
Line 9, “protrusions;” should read -- protrusions, -- and close up right margin;
Lines 10 and 13, close up left margin;
Line 12, “path and,” should read -- path, and -- and close up right margin; and
Line 15, “and” should be deleted.

Signed and Sealed this

Twenty-second Day of April, 2003

JAMES E. ROGAN
*Director of the United States Patent and Trademark Office*